United States Patent [19]

Honda et al.

[11] Patent Number: 4,850,022

[45] Date of Patent: Jul. 18, 1989

[54] SPEECH SIGNAL PROCESSING SYSTEM

[75] Inventors: Masaaki Honda, Kodaira; Takehiro Moriya, Soka, both of Japan

[73] Assignee: Nippon Telegraph and Telephone Public Corporation, Tokyo, Japan

[21] Appl. No.: 255,566

[22] Filed: Oct. 11, 1988

Related U.S. Application Data

[63] Continuation of Ser. No. 712,811, Mar. 18, 1985, abandoned.

[30] Foreign Application Priority Data

Mar. 21, 1984 [JP] Japan ..... 59-53757
Aug. 20, 1984 [JP] Japan ..... 59-173903

[51] Int. Cl.[4] ..... G10L 5/00
[52] U.S. Cl. ..... 381/36; 381/38
[58] Field of Search ..... 381/36, 37, 38, 39, 381/40, 51; 364/513.5

[56] References Cited

U.S. PATENT DOCUMENTS

| | | | |
|---|---|---|---|
| 4,214,125 | 7/1980 | Mozer et al. | 381/32 |
| 4,458,110 | 7/1984 | Mozer | 381/51 |
| 4,472,832 | 9/1984 | Atal et al. | 381/40 |
| 4,561,102 | 12/1985 | Prezas | 381/49 |
| 4,672,670 | 6/1987 | Wang et al. | 381/36 |
| 4,742,550 | 5/1988 | Fette | 381/36 |

OTHER PUBLICATIONS

"*On Synthesizing Natural Sounding Speech by Linear Prediction*", by B. S. Atal, et al., ICASSP 79, Apr. '79, pp. 44–47.

"A Harmonic Deviations Linear Prediction Vocoder for Improved Narrowband Speech Transmission," by V. R. Vishwanathan, ICASSP 82, pp. 610–613, May '82.

*Primary Examiner*—Gary V. Harkcom
*Assistant Examiner*—Lawrence E. Anderson
*Attorney, Agent, or Firm*—Pollock, Vande Sande and Priddy

[57] ABSTRACT

A speech signal processing system in which the correlation is removed from the sample values of a speech waveform supplied to an inverse-filter for obtaining sample values of a prediction residual waveform, phase-equalizing filter coefficients are determined to have phase-characteristic inverse to that of the prediction residual waveform at each pitch position of the speech waveform, the phase-equalizing filter coefficients are set as filter coefficients of the phase-equalizing filter, and the speech waveform or the prediction residual waveform is passed through the phase-equalizing filter, thereby zero-phasing the prediction residual waveform or the prediction residual waveform component in the speech waveform and concentrating energy around the pitch position.

22 Claims, 12 Drawing Sheets e(n)
n0
TIME h*(m,n0)
m=M
m=0
Mth e(n)⊛h*(m,n0)
n0
n1 h*(m,n1)
m=M
m=0 h*(m,n0)
h(m,n)
h*(m,n1)

SPEECH SIGNAL PROCESSING SYSTEM

This application is a continuation of Ser. No. 712,811, filed on Mar. 18, 1985, now abandoned.

BACKGROUND OF THE INVENTION

The present invention relates to a speech signal processing system wherein the prediction residual waveform is obtained by removing the short-time correlation from the speech waveform and the prediction residual waveform is used for coding, for example, a speech waveform.

Prior art speech signal coding systems have two classes of waveform coding and analysis-synthesizing system (vocoder). In a linear predictive coding (LPC) vocoder belonging to the latter class of the analysis-synthesizing system, coefficients of an all-pole filter (prediction filter) representing a speech spectrum envelope are given by the linear prediction analysis of an input speech waveform and then the input speech waveform is passed through an all-zero filter (inverse-filter) whose characteristics are inverse to the prediction filter so as to obtain a prediction residual waveform, and a parameter extracting part serves to extract periodicity as a parameter characterizing said residual waveform (discrimination of voiced or unvoiced sound), a pitch period and average power of the residual waveform and then these extracted parameters and the prediction filter coefficients are sent out. In the synthesizing part, a train of periodic pulses of the received pitch period in the case of a voiced sound or a noise waveform in the case of an unvoiced sound is outputted from an excitation source generating part, in place of the prediction residual waveform, so as to be supplied to a prediction filter which outputs a speech waveform by setting filter coefficients of the prediction filter as the received filter coefficients.

On the other hand, in an adaptive predictive coding (APC) system belonging to the former class of the waveform coding, a prediction residual waveform is obtained in a manner similar to the case of vocoder and then sampled values of this residual waveform are directly quantized (coded) so as to be sent out along with coefficients of a prediction filter. In the synthesizing section, the received coded residual waveform is decoded and supplied to a prediction filter which serves to generate a speech waveform by setting the received predictions filter coefficients in filter coefficients of the prediction filter.

The difference between these two conventional systems resides in the method of coding a prediction residual waveform. The above-stated LPC vocoder can achieve large reduction in bit rate in comparison with the above-stated APC system for transmitting a quantized value of each sample of the residual waveform, because relative to the residual waveform, the LPC vocoder is required to transmit only the characterizing parameters (periodicity, a pitch period, and average electric power). However, on the contrary, in the LPC vocoder, it is impossible to avoid degradation in speech quality caused by replacing a residual waveform with a pulse train or noise, resulting in such as, what is called, a mechanical synthesizing voice. Even though the bit rate increases, enhancement in quality would saturate at about 6 kb/s. As a result, the LPC vocoder has a disadvantage that it cannot provide natural voice quality. Another factor of the lowering quality is that the timing for controlling the prediction filter coefficients cannot be suitably determined relative to each pulse position (phase) in the pulse train supplied to the prediction filter because of lack of information indicating each pitch position. Further the LPC vocoder also has the disadvantage that the lowering of quality is brought about by the extracting of erroneous characterizing parameters from a residual waveform. On the other hand, the above-stated APC system has an advantage that it is possible to enhance speech quality so that it is very close to the original speech by increasing the number of quantizing bits for a residual waveform, but on the contrary, it has the disadvantage that when the bit rate is lowered less than 16 kb/s, quantization distortion increases to abruptly degrade the speech quality.

Moreover, in the prior art systems, there is a possibility that such as an alteration in pitch of a speech signal and combining of speech signal frames happen to be carried out at time locations where signal energy is concentrated, resulting in generation of unnatural speech.

Furthermore, in the prior art as is disclosed in U.S. Pat. No. 4,214,125, F. S. MOZER, "Method and apparatus for speech synthesizing" or U.S. Pat. No. 3,892,919, A. ICHIKAWA, "Speech synthesizing system", it has been proposed to carry out the following processing procedure. After the Fourier transform is carried out on samples in each waveform section of one pitch length cut out from a speech waveform and the resultant sine component is set to zero, that is, the phase of each harmonic component is set to zero, the resultant is subjected to the inverse Fourier transform to zero-phase the cut-out speech waveform, thereby temporarily concentrating the signal energy into a pulsative waveform. Each zero-phased waveform of the pitch length is coded. In the synthesizing part the resultant codes are decoded and the zero-phased waveform sections each having a pitch period duration are concatenated to one another to restore the speech waveform. In this method, erroneous extraction of a pitch period greatly influences the speech quality. The processing distortion is caused by the zero-phasing process applied to a speech waveform. Furthermore, in this method, the location of energy concentration (pulse) caused by the zero-phasing has nothing to do with the portion where energy of the original speech waveform in each pitch length is comparatively concentrated, that is, the pitch location and thus the restored speech waveform synthesized by successively concatenating zero-phased speech waveform sections is far from the original speech waveform and excellent speech quality cannot be obtained.

Further, in J. IECE Jpn. Trans. A, vol. 62-t. No. 3, March 1979, "Function and basic characteristics of SPAC" by Takasugi, the following method is proposed: The auto-correlation function of a speech waveform is obtained, a certain kind of zero-phasing operation is conducted on the speech waveform and each speech waveform section of a pitch length is coded. In the decoding part, the decoded waveform sections are successively concatenated one another. Moreover, the operation of obtaining the auto-correlation function is somewhat similar to performing a square operation, so that the low frequency components with large energy are emphasized, resulting in square-law distortion in the spectrum of the processed signal. In this case, said zero-phasing serves to concentrate energy in the form of a pulse in each pitch period of the auto-correlation function, but, the pulse location does not necessarily coincide with the location where the energy in each pitch period of speech waveform is concentrated and therefore when the decoded waveform sections are connected to one another to reconstruct a speech waveform, the reconstructed speech waveform may be far from the original speech waveform.

SUMMARY OF THE INVENTION

An object of the present invention is to provide a speech signal processing system which can maintain comparatively excellent speech quality even in the case of a bit rate lower than 16 kb/s.

Another object of the present invention is to provide a speech signal processing system which allows to obtain a natural characteristic in the case of concatenating pieces of, for example, speech signals. .

According to the present invention, the speech waveform is, for example, subjected to linear-predictive-analysis and a short-time correlation of the speech waveform is removed from the waveform by an inverse-filter so as to obtain a prediction residual waveform. Then a filter coefficient computing part determines filter coefficients of a phase-equalizing (linear) filter which has reverse phase characteristics to the short-time (for example, shorter than a pitch period) phase characteristics of said prediction residual waveform. The determined filter coefficients are set to a phaseequalizing filter. The above-stated speech waveform or prediction residual waveform is passed through the phase-equalizing filter so as to zero-phase, that is, phase-equalize the prediction residual waveform components of said speech waveform or said prediction residual waveform. This phase-equalized prediction residual waveform (components) has a temporal energy concentration in the form of an impulse in every pitch of the speech waveform and the impulse position almost coincides with the pitch position of the speech waveform (the portion where the energy is concentrated). For example, the concatenation of the speech waveforms is accomplished at the portions where the energy is not concentrated so as to obtain a speech waveform having an excellent nature. Furthermore, since the prediction residual waveform (components) is phase-equalized instead of phase-equalizing the speech waveform, the spectrum distortion caused thereby can be made smaller.

Moreover, when the above-stated phase-equalized speech waveform or prediction residual waveform is coded, efficient coding can be attained by adaptively allocating more bits to, for example, the portions where the energy is concentrated than elsewhere. In this case, it is possible to obtain relatively excellent speech quality even with a bit rate less than 16 kb/s.

In addition, in case the above-stated determination of filter coefficients are adaptatively performed, it is possible to realize more excellent speech quality.

THEORY OF THE INVENTION

Now, the theory of the speech signal processing system according to the present invention will be described. As described above, in the conventional LPC vocoder, a pitch period and average electric power of a residual waveform of a voiced sound are transmitted and on the decoding side, a pulse train having the pitch period is generated and passed through a prediction filter. Accordingly, the pitch positions of the original speech waveform (the positions where the energy is concentrated and much information is included) do not respectively correspond to the pulse positions of a regenerated speech and thus the speech quality is poor. On the other hand, in the present invention, the time axis of the residual waveform within one pitch period is reversed at the pitch position regarded as the time origin and sample values of the time-reversed residual waveform are used as filter coefficients of a phase-equalizing filter; therefore, the output of this phase-equalizing filter is ideally made to be the impulses whose energy is concentrated on the pitch positions of the speech waveform. Consequently, by passing the output pulse train from the phase-equalizing filter through a prediction filter, a waveform whose pitch positions agree with those of the original speech waveform can be obtained, resulting in excellent speech quality. Further, in the case where the speech waveform is passed through said phase-equalizing filter, the residual waveform components are zero-phased and thus the output of the filter has energy concentrated on each pitch position of the speech waveform. Therefore, by allocating more information bits to the residual waveform samples where energy is concentrated and less information bits to the other portions, it is possible to enhance the quality of decoded speech even when a small number of information bits are used in total.

Next, the theory of the invention will be explained with reference to formulas. Letting a sample value of the speech waveform be noted by S(n) and a prediction coefficients obtained by a linear-prediction-analysis of the speech waveform by a(k) (k=1, 2, . . . p), a sample value e(n) of a prediction residual waveform is given by the following equation;

$$e(n) = \sum_{k=0}^{p} a(k) \cdot S(n-k) \tag{1}$$

where a(0)=1. Since the residual waveform e(n) is one which is obtained by removing the spectrum envelope components from the speech waveform, that is, one obtained by removing the correlation between the sample values of the speech waveform, the residual waveform has a flat spectrum envelope and, in the case of voiced sound, has pitch period components of the speech. Thus, the characteristics of this residual waveform are idealized and expressed by the following pulse train;

$$e_M(n) = \sum_{l=0}^{L-1} \delta(n - n_l) \tag{2}$$

where δ(n) is the Kronecker's delta function defined by δ(0)=1 and δ(n)=0 (n≠0). $n_l$ represents a pulse position (i.e. pitch position) and $n_l - n_{l-1}$ corresponds to a pitch period of the speech. Thus, this pulse train function $e_M(n)$ has a pulse only at each pitch position $n_l$ and is zero at the other positions. Since both the residual waveform e(n) and the pulse train $e_M(n)$ have a flat spectrum envelope and the same pitch period components, the difference between both waveforms is based on the difference between the phase-characteristics thereof in a short-time, that is, a time which is shorter than the pitch period. Thus, representing an impulse response of a linear-filter which has characteristics inverse to short-time phase characteristics of the residual waveform by h(n), the following equation (3) allows computation of the phase-equalized (zero-phased) residual waveform $e_p(n)$ which would be obtained by passing the residual waveform e(n) through the linear-filter (phase-equalizing filter) to phase-equalize all the spectrum components;

$$e_p(n) = \sum_{m=0}^{M} h(m)e(n-m) \tag{3}$$

This impulse response h(m) can be given by minimizing the means square error between $e_p(n)$ and $e_M(n)$. The mean square error is given by the following equation;

$$J = \frac{1}{N}\sum_{n=0}^{N-1}\{e_p(n) - e_M(n)\}^2 \tag{4}$$

By substituting the formulas (2) and (3) in equation (4), partial differentiating the modified equation (4) with h(m), and setting the differentiated expression to 0, the impulse response h(m) can be given as a solution of the following simultaneous equations;

$$\sum_{k=0}^{M} V(|m-k|)h(k) = \sum_{l=0}^{L-1} e(n_l - m) \tag{5}$$

where v(k) is an auto-correlation function and is computed by the following equation;

$$V(k) = \sum_{n=0}^{N-k-1} e(n)e(n+k) \tag{6}$$

$$(k = 0, 1, \ldots M)$$

In the case where the time corresponding to the tap number M+1 of the phase-equalizing filter, that is, the response time is shorter than the pitch period, the auto-correlation function can be approximated by $v(k) \simeq v_0 \simeq (k)$ because the residual waveform has a flat spectrum. In short, the residual waveform has a value only in the case of k=0. Thus, equation (5) assumes a value only in the case of m=k, and can be simplified as follows;

$$h(m) = \frac{1}{V_0}\sum_{l=0}^{L-1} e(n_l - m) \tag{7}$$

Further, if the analysis window length N is shorter than a pitch period, the value of L would be one, allowing only one pulse to be present. Thus, the impulse response can be computed by the following equation;

$$h(m) = \frac{1}{V_0} e(n_0 - m) \tag{8}$$

Thus, the impulse response h(m) is equivalent to one that is obtained by reversing the residual waveform in the time domain at the time point $n_0$. Moreover, in case the power spectrum is completely white (the amplitudes of all the frequency components are constant), the Fourier transform of the impulse response h(m) can be expressed by the following equation (9) in which the gain is normalized;

$$\begin{aligned} H(k) &= \sum_{m=0}^{M} h(m)\exp\left(-j\frac{2\pi km}{M+1}\right) \\ &= \exp\left(\frac{-2\pi kn_0}{M+1}\right)\exp\{-argE(k)\} \end{aligned} \tag{9}$$

-continued- $$(K = 0, 1, \ldots M)$$

where E(k) denotes a Fourier transform of the residual waveform e(n). Accordingly, since the Fourier transform $E_p(k)$ of the phase-equalized residual waveform $e_p(n)$ is $E_p(k)=H(k)\cdot E(k)$ in the light of equation (3) and E(k) is $E(k)=|E(k)|\exp\{\arg E(k)\}$, the following equation can be obtained by substituting equation (9) in $E_p(k)$ as follows;

$$E_p(k) = |E(k)|\exp\left(-\frac{2\pi kn_0}{M+1}\right) \tag{10}$$

From equation (10), it will be understood that the phaseequalized residual waveform $e_p(n)$ is one that is obtained by making the residual waveform e(n) zero-phased (all spectrum components are made to have the same zero phase) except for a linear phase component $\exp\{-2\pi kn_0/(M+1)\}$. In the case if it is ideally holds that $|E(k)|=E_0$ (constant), then $e_p(n)$ is to have zero phases and thus is a single pulse waveform. In summary, when the residual waveform e(n) is passed through the phase-equalizing filter having the filter coefficients h(m) as mentioned above, the output waveform becomes one that has energy concentrated mainly at a pitch position, that is, the output waveform takes a shape of a single pulse.

DETAILED DESCRIPTION OF PREFERRED EMBODIMENTS

Figure 1:
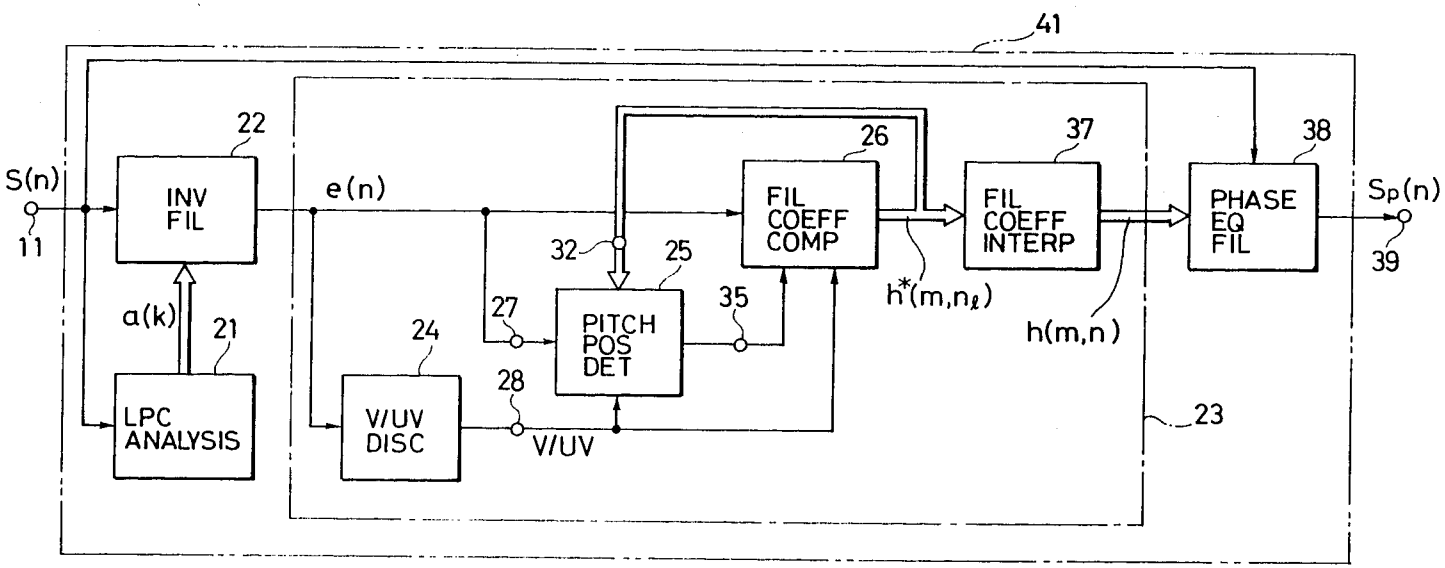
FIG. 1 is a block diagram showing a speech signal processing system of the present invention, particularly an example of the arrangement of an adaptive phase-equalizing processing system.

Next, a concrete embodiment of the speech signal processing system of this invention will be described with reference to FIG. 1. Sample values S(n) of a speech waveform are inputted at an input terminal 11 and are supplied to a linear prediction analysis part 21 and an inverse-filter 22. The linear prediction analysis part 21 serves to compute prediction coefficients a(k) in equation (1) on the basis of a speech waveform S(n) by means of the linear prediction analysis. The prediction coefficients a(k) are set as filter coefficients of the inverse-filter 22. Thus, the inverse-filter 22 serves to accomplish a filtering operation expressed by equation (1) on the basis of the input of the speech waveform S(n) and then to output a prediction residual waveform e(n), which is identical with such a waveform is obtained by removing from the input speech waveform a short-time correlation (correlation among sample values) thereof. This prediction residual waveform e(n) is supplied to a voiced/unvoiced sound discriminating part 24, a pitch position detecting part 25 and a filter coefficients computer part 26 in a filter coefficient determining part 23. The voiced/unvoiced sound discriminating part 24 serves to obtain an auto-correlation function of the residual waveform e(n) on the basis of a predetermined number of delayed samples and to discriminate a voiced sound or an unvoiced one in such a manner that if the maximum peak value of the function is over a threshold value, the sound is decided to be a voiced one and if the peak value is below the threshold value, the sound is decided to be an unvoiced one. This discriminated result V/UV is utilized for controlling a processing mode for determining phase-equalizing filter coefficients. In this example, in order to adaptively vary the phase-equalizing characteristics of a phase-equalizing filter 38 in accordance with the change in phases of the residual waveform, the adaptation of the characteristics is carried out in every pitch period in the case of the voiced sound. Let it be assumed that the time point n is located at the (l−1)th pitch position $n_{l-1}$ and the phase-equalizing filter coefficients at the time point, expressed by $h^*(m, n_{l-1})$ (m=0, 1, . . . M) are preknown. The pitch position detecting part 25 serves to detect the next pitch position $n_l$ by using the pitch position $n_l-1$ and the filter coefficients $h^*(m, n_{l-1})$.

Figure 2:
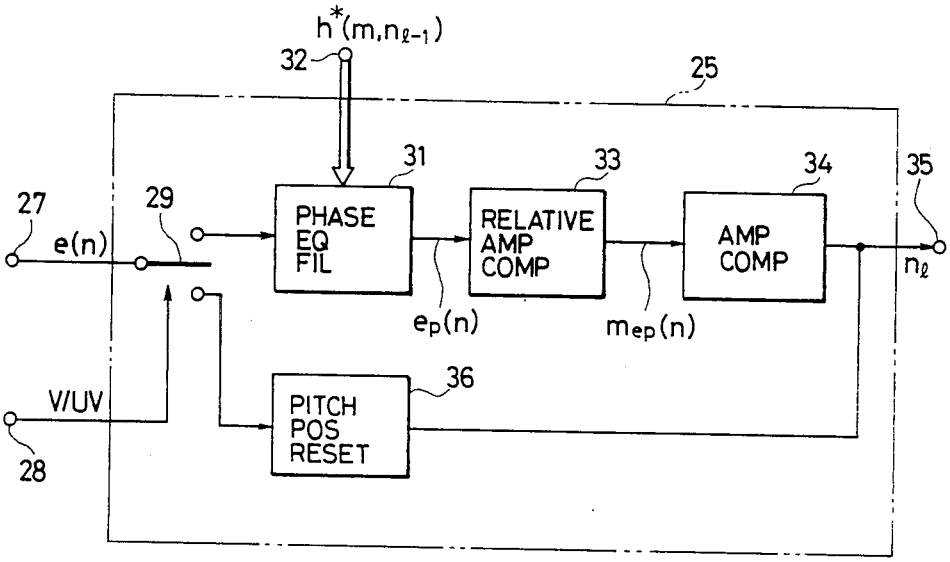
FIG. 2 is a block diagram showing the internal arrangement example of a pitch position detecting part 25 in FIG. 1.

FIG. 2 shows an internal arrangement of the pitch position detecting part 25. The residual waveform e(n) from the inverse-filter 22 is inputted at an input terminal 27 and the discriminated result V/UV from the discriminating part 24 is inputted at an input terminal 28. A processing mode switch 29 is controlled in accordance with the inputted result V/UV. When a sound is discriminated to be a voiced sound V, the residual waveform e(n) inputted at the terminal 27 is supplied through the switch 29 to a phase-equalizing filter 31 which serves to accomplish a convolutional operation (an operation similar to equation (3)) between the residual waveform e(n) and the filter coefficients $h^*(m, n_{l-1})$ inputted at an input terminal 32, thereby producing a phase-equalized residual waveform $e_p(n)$. A relative amplitude computing part 33 serves to compute a relative amplitude $m_{ep}(n)$ at the time point n of the phase-equalized residual waveform $e_p(n)$ by the following equation;

$$m_{ep}(n) = e_p(n)/\sqrt{\sum_{k=-M/2}^{M/2} e_p^2(n+k)} \tag{11}$$

An amplitude comparator 34 serves to compare the relative amplitude $m_{ep}(n)$ with a predetermined threshold value $m_{th}$ and outputs the time point n as a pitch position $n_l$ at an output terminal 35 when the condition $$m_{ep}(n) > m_{th}\ (n > n_{l-1}) \tag{12}$$

is fulfilled.

Next, this position $n_l$ is supplied to the filter coefficient computing part 26 in FIG. 1 which serves to compute the phase-equalizing filter coefficients $h^*(m, n_l)$ at the pitch position $n_l$ by the following equation (13). The phase-equalizing filter coefficients $h^*(m, n_l)$ are supplied to a filter coefficient interpolating part 37 and the phase-equalizing filter 31 in FIG. 2.

$$h^*(m, n_l) = e\left(n_l + \frac{M}{2} m\right)/\sqrt{\frac{1}{M+1}\sum_{k=-M/2}^{M/2} e^2(n_l + k)} \tag{13}$$

As will be understood from the denominator, equation (13) is different from equation (8) in the respect that the gain of the filter is normalized and the delay of the linear phase component ($\exp\{--2\pi k n_l/(M+1)\}$ in equation (10)) is compensated. Namely, as is obvious from equation (10), h(m) obtained by equation (8) is delayed by M/w sample in comparison with an actual h(m). Thus, equation (13) should be utilized.

On the other hand, when the sound is discriminated to be unvoiced sound (UV), in FIG. 2, the processing mode switch 29 is switched to a pitch position resetting part 36 which receives the input residual waveform e(n) and sets the pitch position $n_l$ at the last sampling point within the analysis window. Further, in the case of the unvoiced sound UV, the filter coefficient computing part 26 in FIG. 1 sets the filter coefficients to $h^*(m, n_l) = 1(m=M/2)$ and $h^*(m, n_l)=0(m\neq M/2)$. The filter coefficients h(m, n) at each time point n are computed as smoothed values by using a first order filter as expressed, for example, by the following equation in the filter coefficient interpolating part 37;

$$h(m, n) = \alpha h(m, n-1) + (1+\alpha)h^*(m, n_l)(n_{l-1} < n \leqq n_l) \tag{14}$$

where $\alpha$ denotes a coefficient for controlling the changing speed of the filter coefficients and is a fixed number which fulfills $\alpha < 1$.

Figures 15A, 15B, 15C, 15D, 15E:
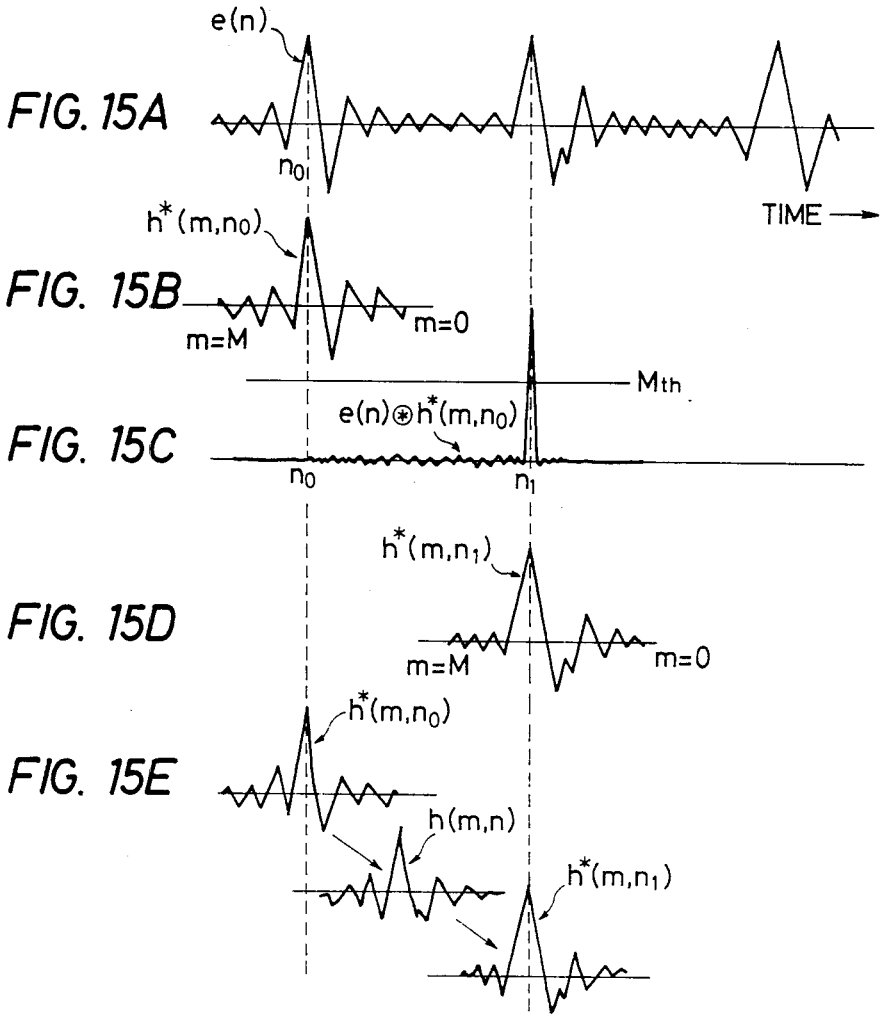
FIGS. 15A to 15E are diagrams respectively showing examples of waveforms in the process of obtaining filter coefficients h(m,n) in FIG. 1.

The operations of the pitch position detecting part 25, the filter coefficient computing part 26 and the filter coefficient interpolating part 37 stated above will now be described with reference to FIGS. 15A to 15E. The residual waveform e(n) (FIG. 15A) from the inverse-filter 22 is convolutional-operated with the filter coefficients $h^*(m, n_0)$ (FIG. 15B) in the phase-equalizing filter 31. The resultant of e(n) $h(m, n_0)$( ⊛ denotes a convolutional operation) generates an impulse at the next pitch position $n_1$ of the residual waveform e(n) as shown in FIG. 15C and renders the waveform positions before and after the pitch position within a pitch period into zero. When the amplitude of this impulse is over the predetermined value $M_{th}$, the amplitude comparing part 34 detects the time point as the pitch position $n_l=n_1$. The operation of equation (13) is performed in relation with this detected pitch position $n_l=n_1$ in the filter coefficient computing part 26 so as to result in obtaining the filter coefficients $h^*(m, n_1)$ as shown in FIG. 15D. The filter coefficients $h^*(m, n_1)$ are set in the phase-equalizing filter 31 to be convolutional-operated with the residual waveform, thereby obtaining the next pitch position $n_l=n_2$ in a similar manner. The foregoing procedure is repeated. On the other hand, after the filter coefficients $h^*(m, n_0)$ are obtained at the pitch position $n_l=n_0$, the filter coefficient interpolating part 37 interpolates the coefficients in accordance with the operation of equation (14) so as to obtain the filter coefficients h(m,n). At the pitch position of $n_l=n_1$, the interpolation of the filter coefficients h(m,n) is similarly accomplished by using the filter coefficients $h^*(m, n_1)$.

The phase-equalizing filter 38 serves to accomplish the convolutional operation shown in the following equation (15) by utilizing the input speech waveform S(n) and the filter coefficients h(m,n) from the filter coefficient interpolating part 37 and to output a phase-equalized speech waveform $S_p(n)$, that is, the speech waveform S(n) whose residual waveform e(n) is zero-phased, at the output terminal 39.

$$s_p(n) = \sum_{m=0}^{M} h(m, n)\, S(n-m) \tag{15}$$

The speech quality of the phase-equalized waveform $S_p(n)$ thus obtained is indistinguishable from the original speech quality.

Second Embodiment

Figure 3:
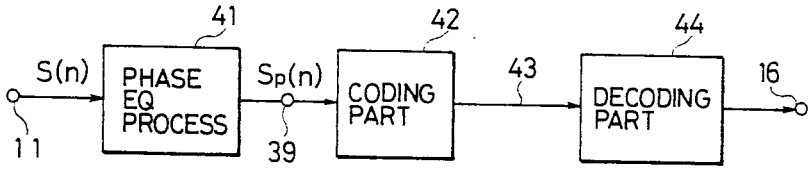
FIG. 3 is a block diagram showing an example of a basic arrangement for speech coding by utilizing the phase-equalizing processing.

Next, digital-coding of the phase-equalized speech waveform $S_p(n)$ will be described. The basic arrangement for digital-coding is shown in FIG. 3. A phase-equalizing processing part 41 having the same arrangement as shown in FIG. 1 performs the phase-equalizing processing on the speech waveform S(n) supplied to the input terminal 11 and outputs the phase-equalized speech waveform $S_p(n)$. A coding part 42 performs digital-coding of this phase-equalized speech waveform $S_p(n)$ and sends out the code series to a transmission line 43. On the receiving side, a decoding part 44 regenerates the phase-equalized speech waveform $S_p(n)$ and outputs it at an output terminal 16. As described above, the coding and decoding are performed with respect to the phase-equalized speech waveform $S_p(n)$ instead of the speech waveform S(n). Since the quality of speech waveform $S_p(n)$ produced by phase-equalizing the speech waveform S(n) is indistinguishable from that of the original speech waveform S(n), it is not necessary to transmit the filter coefficients h(m) to the receiving side and thus it would suffice to regenerate the phase-equalized speech $S_p(n)$. Particularly, since the residual waveform $e_p(n)$ produced by phase-equalizing the residual waveform e(n) has the portions where energy is concentrated, such an adaptive coding as providing more information for the energy concentrated portions than the other portions enables a high quality speech transmission with less information bits. It is possible to adopt various methods as the coding scheme in the coding part 42. Hereinafter, there will be shown four examples of methods which are suitable for the phase-equalized speech waveform.

The method using a variable tree coding

Figure 4:
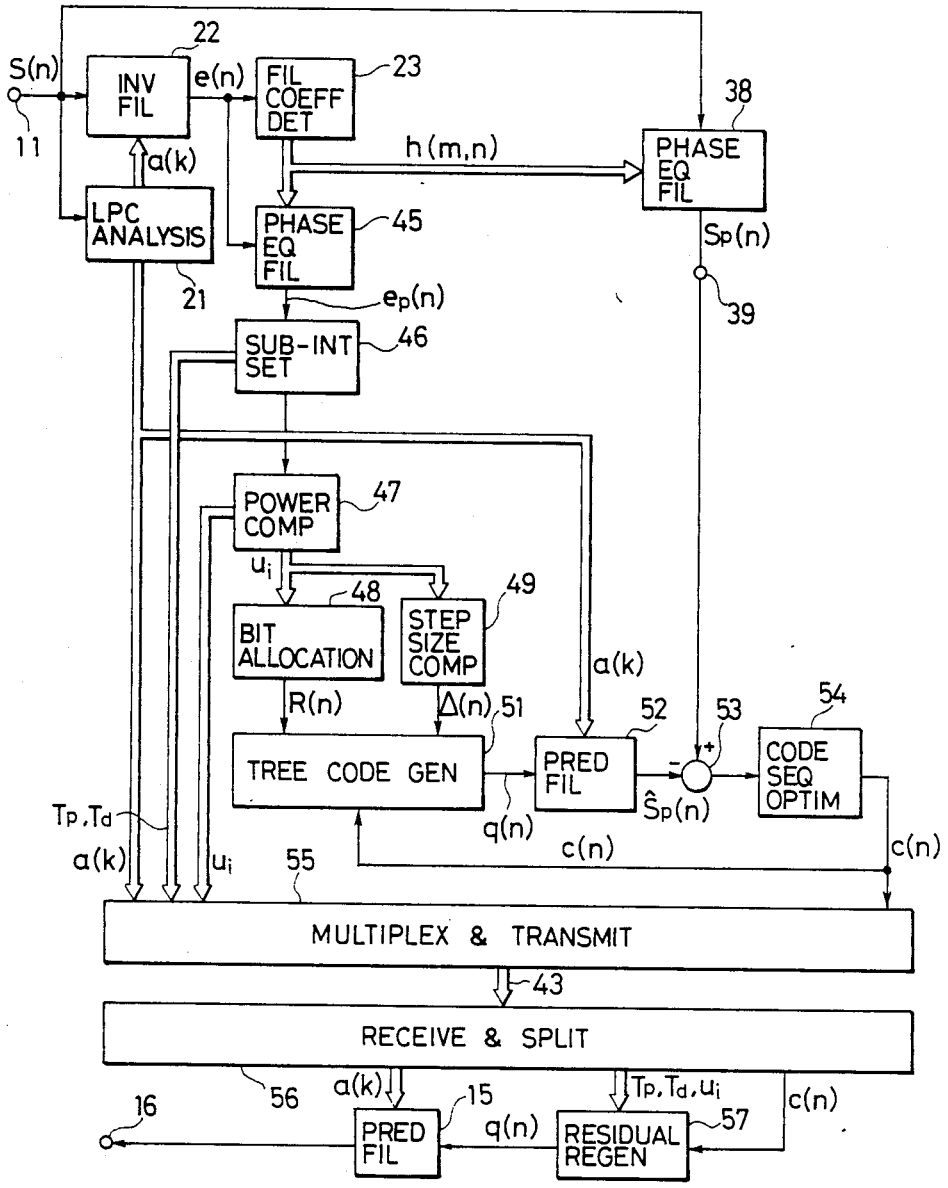
FIG. 4 is a block diagram showing an example of an arrangement for variable-rate tree-coding of a speech waveform.

The variable rate tree-coding method is characterized in that the quantity of information is adaptively controlled in conformity with the amplitude variance along the time base of the prediction residual waveform obtained by linear-prediction-analyzing a speech waveform. FIG. 4 shows an embodiment of the coding scheme, where the phase-equalizing processing according to the present invention is combined with the variable rate tree-coding. A linear-prediction-coefficient analysis part (hereinafter referred to as LPC analysis part) 21 performs linear-prediction-analysis on the speech waveform S(n) supplied to an input terminal 11 so as to compute prediction coefficients a(k) and an inverse-filter 22 serves to obtain a prediction residual waveform e(n) of the speech waveform S(n) using the prediction coefficients. A filter coefficient determining part 23 computes coefficients h(m,n) of a phase-equalizing filter for equalizing short-time phases of the residual waveform e(n) by means of the method stated in relate to FIG. 1 and sets the coefficients in a phase-equalizing filter 38. The phase-equalizing filter 38 performs the phase-equalizing processing on the inputted speech waveform S(n) and outputs the phase-equalized speech waveform $S_p(n)$ at a terminal 39.

Figure 5:
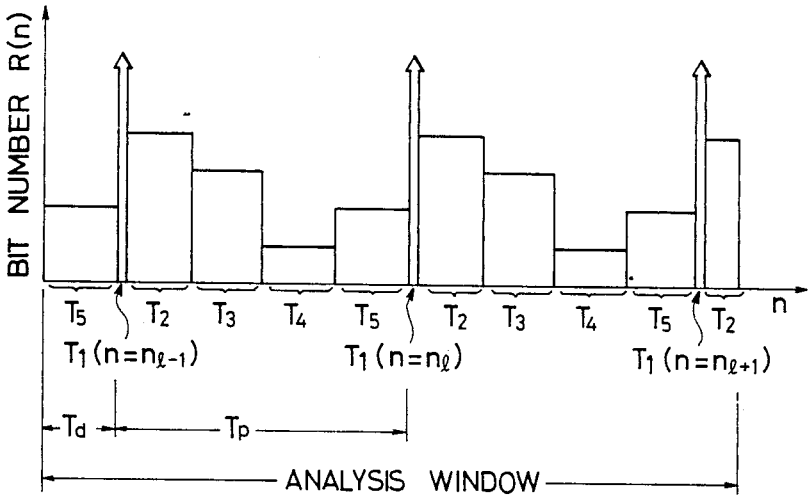
FIG. 5 is an explanatory diagram in relation to the setting of sub-intervals.

On the other hand, the residual waveform e(n) is also phase-equalized in a phase-equalizing filter 45. Then, a sub-interval setting part 46 sets sub-intervals for dividing the time base in accordance with the deviation in amplitude of the residual waveform and a power computing part 47 computes electric power of the residual waveform at each sub-interval. As shown in FIG. 5, the sub-intervals are composed of a pitch position $T_1$ and those intervals ($T_2$ to $T_5$) defined by equally dividing each interval between adjacent pitch positions ($n_l$), that is, dividing each pitch period $T_p$ within an analysis window. The residual power $u_i$ in the respective sub-intervals is computed by the following equation (16);

$$u_i = \frac{1}{N_{Ti}} \sum_{n \in T_i} \theta^2\, p(n) \tag{16}$$

where $T_i$ denotes a sub-interval to which a sampling point n belongs and $N_{Ti}$ denotes the number of sampling points included in the sub-interval $T_i$. A bit-allocation part 48 computes the number of information bits R(n) to be allocated to each residual sample on the basis of the residual electric power $u_i$ in each sub-interval in accordance with equation (17);

$$\overline{R}(n) = R + \frac{1}{2} \log_2 \frac{u_i}{\prod_{j=1}^{N_s} u_i^{w_i}} \tag{17}$$

where $\overline{R}$ denotes an average bit rate for the residual waveform $e_p(n)$, $N_s$ denotes the number of sub-intervals and $w_i$ denotes a time ratio of a sub-interval given by the following equation, $$w_i = N_{Ti} / \sum_{j=0}^{N_s} N_{Tj}.$$

Figure 6:
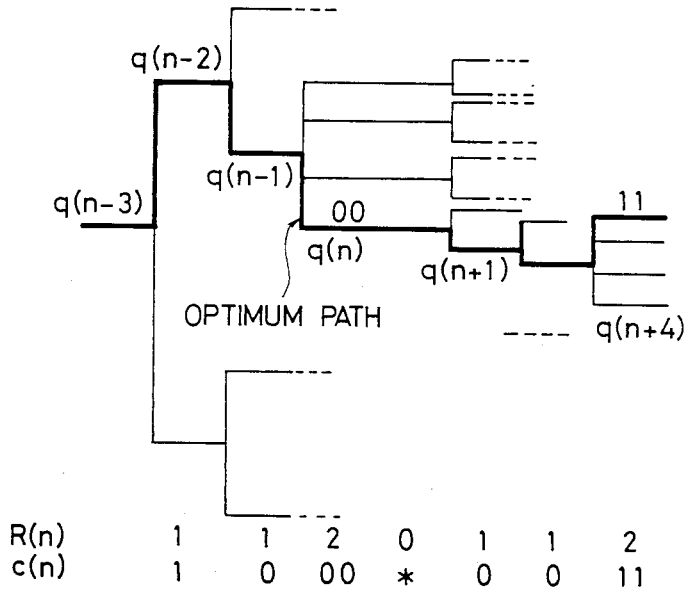
FIG. 6 is an explanatory diagram showing an arrangement for variable-rate tree coding.

The quantization step size $\Delta(n)$ is computed on the basis of the residual power $u_i$ in a step size computing part 49 by the following equation (18);

$$\Delta(n) = Q(R(n)) \sqrt{u_i} \quad n \epsilon T_i \tag{18}$$

where Q(R(n)) denotes a step size of Gaussian quantizer being R(n) bits. The bit number R(n) and the step size $\Delta(n)$ respectively computed in the bit-allocation part 48 and the step size computing part 49 control a tree code generating part 51. The tree code generating part 51 operates in accordance with a variable-rate tree structure as shown in FIG. 6 and outputs sampled values q(n) given to the respective branches along a path defined by a code series $C(n)+\{c(n-L), \ldots, c(n-1), c(h)\}$. The number of branches derived from respective nodes is given as $2^{R(n)}$. The sampled values f(l,n) assigned to respective branches are given on the basis of $\Delta(n)$ and R(n) by the following equation (19);

$$f(l, n) = \mathrm{Sgn}(l) \frac{|l| + 0.5}{2} \Delta(n) \tag{19}$$

$$l = \pm 1, \pm 2 \ldots, \pm 2^{R(n)-1}$$

where Sgn(l) denotes a negative or a positive sign of "l". Further, q(n) can be given as q(n)=f(l*,n) where a branch on the path is defined as l*. In FIG. 4, the sampled values q(n) produced from the tree code generating part 51 are inputted to a prediction filter 52 which computes local decoded values $\hat{S}_p(n)$ by means of an all-pole filter on the basis of the following equations (20);

$$\hat{S}_p(n) = \sum_{k=1}^{P} a(k) \hat{S}_p(n-k) + q(n) \tag{20}$$

where a(k) denotes prediction coefficients which are supplied from the LPC analysis part 21 for controlling filter coefficients of the prediction filter 52. A subtractor 53 produces a difference between the local decoded value $\hat{S}_p(n)$ and the phase-equalized speech waveform $S_p(n)$ and supplies the difference to a code sequence optimizing part 54, which searches for a code sequence $C(n)=\{c(n-L), \ldots, c(n-1), c(n)\}$, that is, a path of a tree code that minimizes the mean square error between the local decoded value $\hat{S}_p(n)$ and the phase-equalized speech waveform $S_p$. The search method for an optimum path utilizes, for example, the ML algorithm. According to the ML algorithm, candidates of code sequences in the tree codes shown in FIG. 6 are defined as $C_m(n)=\{c_m(n-L), \ldots, c_m(n-1), c_m(n)\}$ where m=1, 2, . . . M' and then an evaluation value d(m,n) of an error at each node is computed as a mean square error between the time sequences of the sample values $\hat{S}_p(n)$ given to the code sequence candidates $C_m(n)$ and the input sample values $S_p(n)$ as defined by the following equation;

$$d(n, m) = \sum_{t=n-L}^{M} \{S_p(t) - \hat{S}_p(t)\}^2$$

Next, the code sequence $C_m(n)$ whose evaluation value d(n,m) is minimized is selected among M' candidates of the code sequences and the code $c_m(n-L)$ at the time (n−L) in the path is determined as the optimum code. The code sequence candidates $C_m(n+1)=\{c_m(n+1-L), \ldots c_m(n), c_m(n+1)\}$ at the time point (n+1) are obtained by selecting M code sequences $C_m(n)$ in order of smaller values of d(n,m) and then adding all the available codes c(n+1) at the time (n+1) to each of the M code sequences. The processing stated above is sequentially accomplished at respective time points and the optimum code c(n−L) at the time point (n−L) is outputted at the time point n. In addition, the mark * in FIG. 6 denotes a null code and the thick line therein denotes an optimum path.

In the coding system of this embodiment, a multiplexer transmitter 55 sends out to a transmission line 43 the prediction coefficients a(k) from the LPC analysis part 21, the period $T_p$ and the position $T_d$ of sub-intervals from the sub-interval setting part 46 and the sub-interval residual power $u_i$ from the power computing part 47, all as side information, along with the code c(n) of the residual waveform, after being multiplexed.

On the receiving side, after respective information signals are separated from one another in a multiple-signal splitting part 56, a residual waveform regenerating part 57 similarly computes the number of quantization bits R(n) and the quantization step size $\Delta(n)$ on the basis of the received pitch period $T_p$, the pitch position $T_d$ and the sub-interval residual power $u_i$, similarly with the transmitting side and also computes decoded values q(n) of the residual waveform in accordance with the received code sequence C(n) using the computed R(n) and $\Delta(n)$. A prediction filter 15 is driven with the decoded values q(n) applied thereto as driving sound source information. The speech waveform $S_p(n)$ is restored as the filter coefficients of the prediction filter 15 are controlled in accordance with the received prediction coefficients a(k) and then is delivered to an output terminal 16. The method for coding a speech waveform by the tree-coding has been, heretofore, disclosed in some thesises such as J.B. Anderson "Tree coding of speech" IEEE Trans. IT-21 July 1975. In this conventional method where the speech waveform S(n) is directly tree-coded, when the coding is carried out at a small bit rate, quantization error becomes dominant at the portions where the energy of the speech waveform S(n) is concentrated. Further, it has been, heretofore, proposed that the number of quantization bits be fixed at a constant value. However, the adaptive control of the number of quantization bits as well as a quantization step size has not been practiced in the prior art.

Figure 7A:
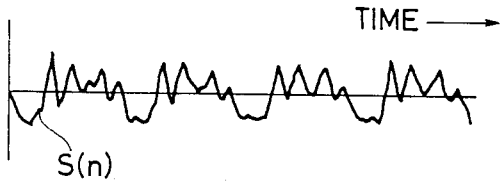
FIGS. 7A to 7G are diagrams showing the waveform examples at respective parts in the speech signal processing system.
Figure 7B:
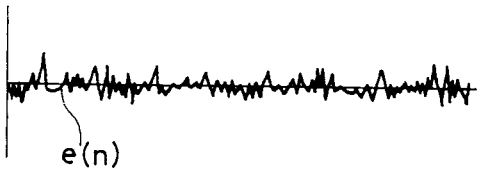
Figure 7C:
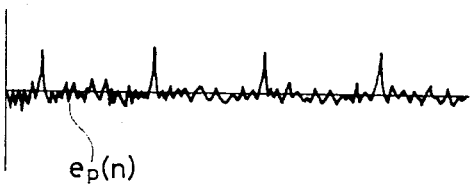
Figure 7D:
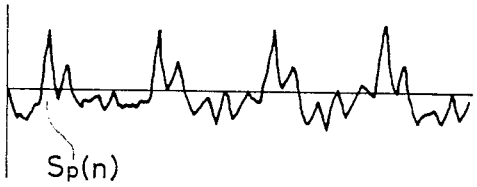

On the other hand, in this embodiment, the input speech waveform S(n) (e.g. the waveform in FIG. 7A) is passed through the inverse-filter 22 so as to be changed to the prediction residual waveform e(n) as shown in FIG. 7B. This prediction residual waveform e(n) is zero-phased in the phase-equalizing filter 45, producing a zero-phased residual waveform $e_p(n)$ having energy concentrated around each pitch position. The number of bits R(n) is more allocated to the samples on which energy is concentrated than allocated to the other samples. Namely, heretofore, the number of branches at respective nodes of a tree code has been fixed at a constant value, that is, the number of quantization levels; however, in this embodiment, the number of branches are generally more than the constant value at the nodes corresponding to the portions where energy is concentrated as shown in FIG. 6. The phase-equalized speech waveform $S_p(n)$ produced by passing the speech waveform S(n) through the phase-equalizing filter 38 also has a waveform in which energy is concentrated around each pitch position as shown in FIG. 7D. Similarly with above, the number of bits R(n) to be allocated is increased at the energy-concentrated portions, that is, the number of branches at respective nodes of a tree code is made large. Thus, even if the bit rate is selected, as a whole, to be equal to that of the prior art, the present embodiment is superior to the prior art in respect of quantization error in the decoded speech waveform. Namely, the present embodiment is characterized by an arrangement in which a speech waveform is modified to have energy concentrated at each pitch position and the number of branches at the nodes of the tree code for coding the waveform portion corresponding to the pitch position is increased. Thus, even though energy is concentrated at every pitch location, large quantization error, which results in degradation in speech quality, may be caused if it is not arranged to vary the number of branches at the nodes corresponding to the energy-concentrated portions as the prior art systems are not arranged to.

The method using a multi-pulse coding

Figure 8:
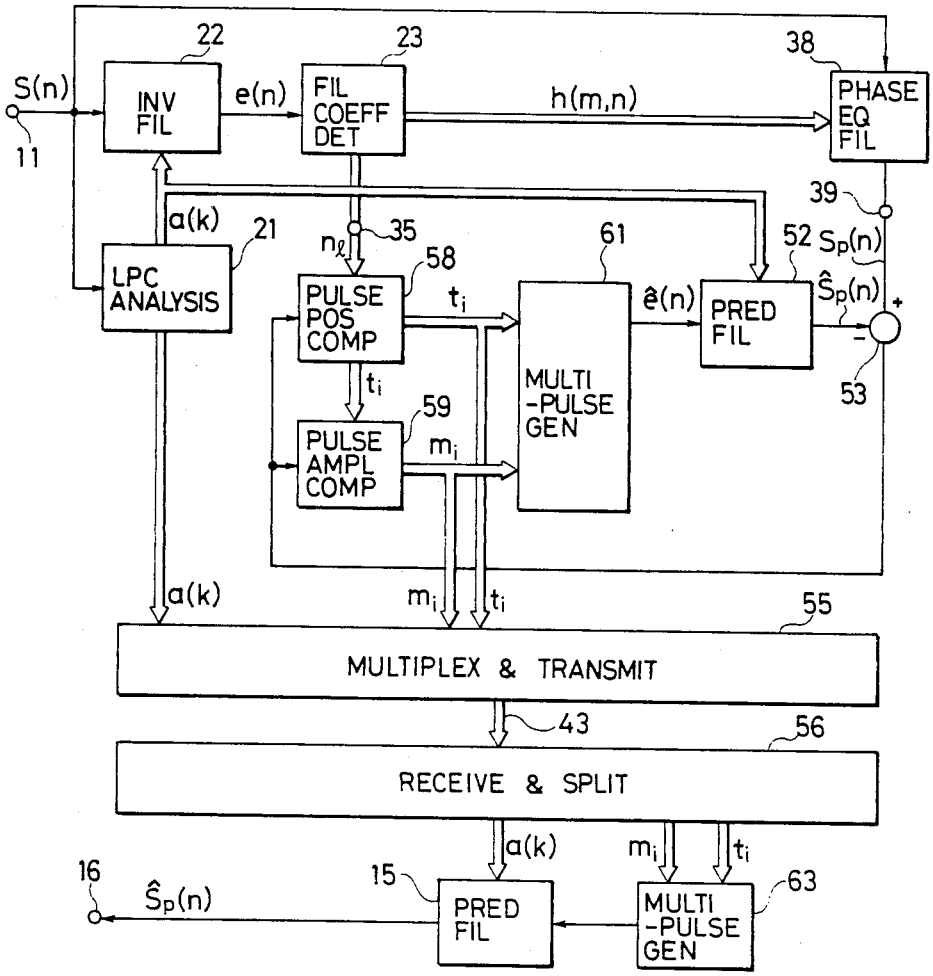
FIG. 8 is a block diagram showing an example of an arrangement of a speech signal multi-pulse-coding utilizing the phase-equalizing processing.

The fundamental theory of the multi-pulse coding has been proposed by Atal at the International Conference on Sound and Speech Signal Processing in 1982 (Proceeding ICASSP pp. 614–617) and also in Atal et al U.S. Pat. No. 4,472,832. According to this coding scheme, a prediction residual waveform of a speech is expressed by a train of a plurality of pulses (i.e. multi-pulse) and the time locations on the time axis and the intensities of respective pulses are determined so as to minimize the error between a speech waveform synthesized from the residual waveform of this multi-pulse and an input speech waveform. In this conventional method, the speech waveform is directly coded; contrary thereto, in the embodiment of the present invention, a phase-equalized speech waveform is used as an input to be subjected to multi-pulse coding. FIG. 8 shows an embodiment of the coding system, in which the phase-equalizing processing is combined with the multi-pulse coding.

A linear-prediction-analysis part 21 serves to compute prediction coefficients from samples S(n) of the speech waveform supplied to an input terminal 11 and a prediction inverse-filter 22 produces a prediction residual waveform e(n) of the speech waveform S(n). A filter coefficient determining part 23 determines, at each sample point, coefficients h(m,n) of a phase-equalizing filter and also determines a pitch position $n_l$ on the basis of the residual waveform e(n). The phase-equalizing filter 38 whose filter coefficients are set to h(m,n), phase-equalizes the speech waveform S(n) and the output therefrom is subtracted at a subtractor 53, by a local decoded value $S_p(n)$ of the multi-pulse. The resultant difference output from the subtractor 53 is supplied to a pulse position computing part 58 and a pulse amplitude computing part 59. The local decoded value $\hat{S}_p(n)$ is obtained by passing a multi-pulse signal $\hat{e}(n)$ from the multi-pulse generating part 61 through a prediction filter 52 as defined by the following equation:

$$\hat{S}_p(n) = -\sum_{k=1}^{P} a(k)\,\hat{S}_p(n-k) + \hat{e}(n)$$

The multi-pulse signal $\hat{e}(n)$ is given by the following equation where the pulse position is $t_i$ and the pulse amplitude is $m_i$;

$$\hat{e}(n) = \sum_{i=1}^{q} m_i \delta(t - t_i)$$

The pulse position computing part 58 and the pulse amplitude computing part 59 respectively determine the pulse position $t_i$ and the pulse amplitude $m_i$ so as to minimize average power Pe of the difference between the waveforms $S_p(n)$ and $\hat{S}_p(n)$. In the algorithm shown in the above-referred thesis, supposing that (l−1) sets of $t_i$ and $m_i$ are given, then, lth pulse position $t_l$ is determined as a time point for minimizing the average power Pe in such a manner that the pulse amplitude $m_i$ is determined using the least square method to minimize the average power Pe for all the available positions (where $t_l \neq t_i$, $i=1, \ldots, l-1$) and the time point corresponding to the determined $m_i$ is decided to be the lth pulse position $t_l$. This process is successively performed from $l=1$ to $l=q$ and all the pulse positions and amplitudes are decided. This algorithm requires a great deal of processing for computing pitch positions. On the other hand, in the embodiment of the present invention, in order to reduce the amount of processing, the starting q' pulse positions are decided as $t_i=n_i$ ($i=1, 2, \ldots q'$) by utilizing the pitch position $n_i$ ($i=1, 2, \ldots q'$) obtained in the phase-equalizing process. The pulse positions and the number of pulses at the other positions are determined in a manner similar to the conventional method, however since the quantity of information content related to a speech waveform is very small at these positions, the amount of the processing-computing need not be so much. A multiplexer transmitter 55 multiplexes prediction coefficients a(k), a pitch position (i.e. time point) $t_i$ and a pitch amplitude $m_i$ and sends out the multiplexed code stream to a transmission line 43. In the receiving side, after splitting the received code stream into individual code signals by a receiver/splitter 56 the separated pitch amplitude $m_i$ and the pitch position $t_i$ are supplied to a multi-phase generating part 63 to generate a multi-pulse signal, which is then passed through the prediction filter 15 so as to obtain a phase-equalized speech signal $\hat{S}_p(n)$ at an output terminal 16. This multi-pulse generating processing is similar to the conventional one.

Figure 9:
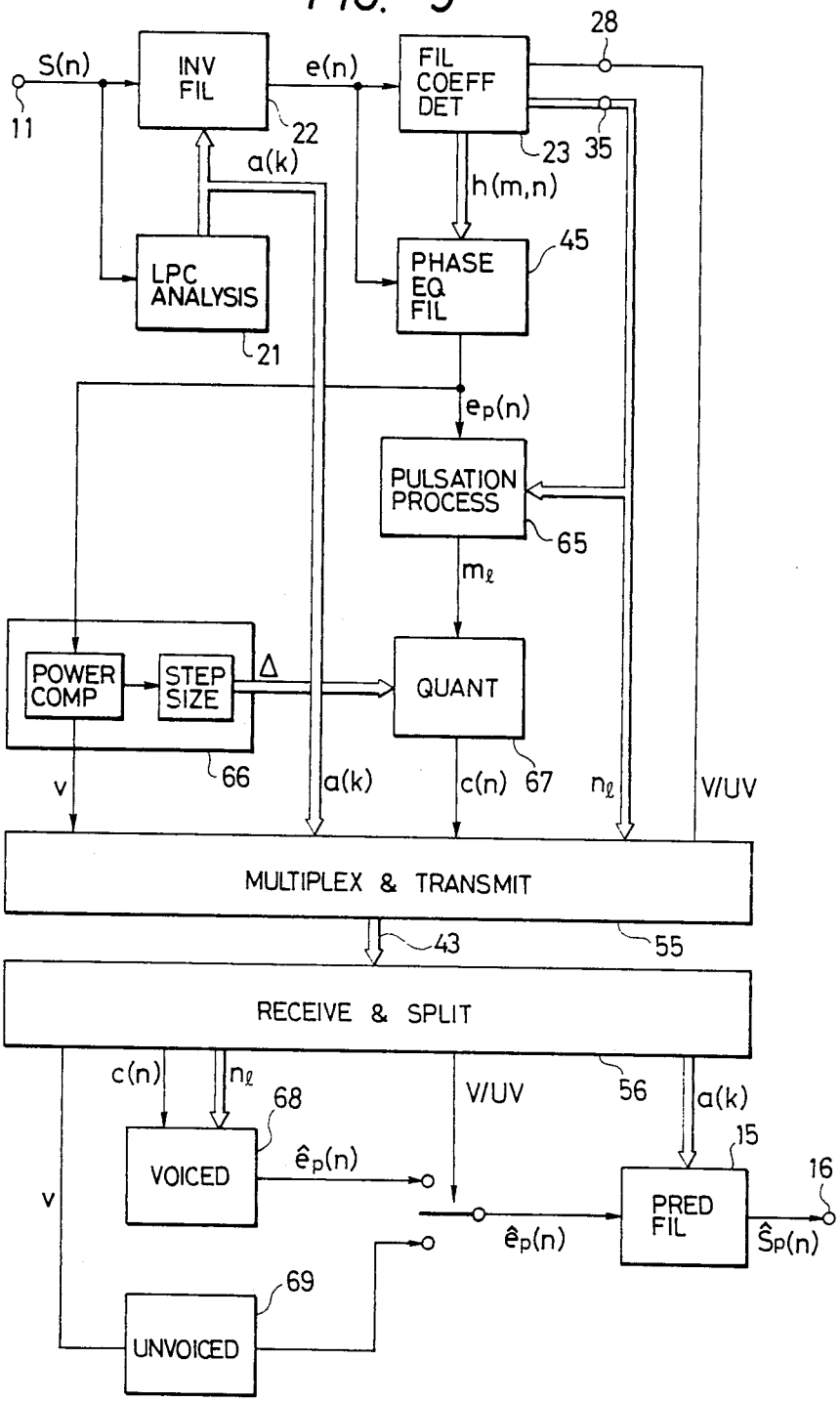
FIG. 9 is a block diagram showing an example of an arrangement of a speech analysis-synthesizing system on the basis of a zero-phased residual waveform.

The speech analysis-synthesizing system utilizing a pulsated residual waveform In this embodiment, in the time-sequence of the samples of the prediction residual waveform phase-equalized by the above-stated phase-equalizing processing, the samples are left at the pitch positions and values of those samples at the other positions are set to zero so as to pulsate the prediction residual waveform and a prediction filter is driven by applying thereto a train of these pulses as a driving sound source signal so as to generate a synthesized speech. This embodiment is shown in FIG. 9. The LPC analysis part 21 computes prediction coefficients a(k) from the samples S(n) of the speech waveform supplied at the input terminal 11, and the prediction residual waveform e(n) of the speech waveform S(n) is obtained by the prediction inverse-filter 22. Next, the filter coefficient determining part 23 determines phase-equalized filter coefficients h(m,n), a voiced/unvoiced sound discriminating value V/UV and the pitch position $n_l$ on the basis of the residual waveform e(n). After the residual waveform e(n) is phase-equalized in the phase-equalizing filter 45, the phase-equalized residual waveform $e_p(n)$ at the pitch position n is sampled in a pulsation-processing section 65 and the sampled value is given as $m_l = e_p(n_l)$ ($l=1,2, \ldots L$). L denotes the number of pitch positions within the analysis window. The phase-equalized residual waveform $e_p(n)$ is also supplied to a quantization step size computing part 66, where a quantized step size Δ is computed. The sampled value $m_l$ is quantized with the size Δ in a quantizer 67. The multiplexer/transmitter 55 multiplexes a quantized output c(n) of the quantizer 67, the pitch position $n_l$, prediction coefficients a(k), the voiced/unvoiced sound discriminating value V/UV and the residual power v of the phase-equalized residual waveform used for computing the quantization step size Δ in the quantization step size computing part 66. The multiplexer/splitter 55, 56 separate the received signal. A voiced sound processing part 68 decodes the separated quantized output c(n) and the results are utilized along with the pitch positions $n_l$ to generate the pulse train $$\hat{e}_p(n) = \sum_{l=1}^{L} m_l \delta(n - n_l)$$

(which is equation (2) multiplied by $m_l$). An unvoiced sound processing part 69 generates a white noise of the electric power equal to v separated from the received multiplex signal. By controlling a switch in accordance with the separated voiced/unvoiced sound discriminating value V/UV, the output of the voiced sound processing part 68 and the output of the unvoiced sound processing part 69 are selectively supplied to the prediction filter 15 as driving sound source information. The prediction filter 15 provides a synthesized speech $\hat{S}_p(n)$ to the output terminal 16.

In the conventional LPC vocoder, the pitch period is sent to the synthesizing side where the pulse train of the pitch period is given as driving sound source information for the prediction filter; however, in the embodiment shown in FIG. 9, each pitch position $n_l$ and c(n) which is produced by quantizing (coding) the level of the pulse produced by phase-equalization (i.e. pulsation) for each pitch period, are sent to the synthesizing side where one pulse having the same level as c(n) decoded at each pitch position is given as driving sound source information to the prediction filter instead of giving the above-mentioned pulse train of the LPC vocoder. That is to say, in this embodiment, a pulse whose level corresponds to the level of the original speech waveform S(n) at each pitch position of S(n) is given as driving sound source information and, therefore, the quality of the synthesized speech is better than that of the LPC vocoder. With regard to the unvoiced sound, it is the same as the case of using the LPC vocoder. Further, in the embodiment shown in FIG. 9, it is possible to omit the quantization step size computing part 66 and to arrange that only those of the pitch position $n_l$, the voiced/unvoiced sound discriminating value V/UV, the residual power v and the prediction coefficients a(k) are multiplexed and transmitted to the synthesizing side where one pulse having a level corresponding to the residual power v is generated at each pitch position in the case of the voiced sound V and the pulse is supplied to the prediction filter 15 as driving sound source information.

Figure 7E:
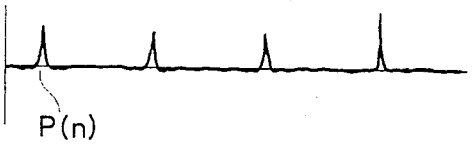
Figure 10:
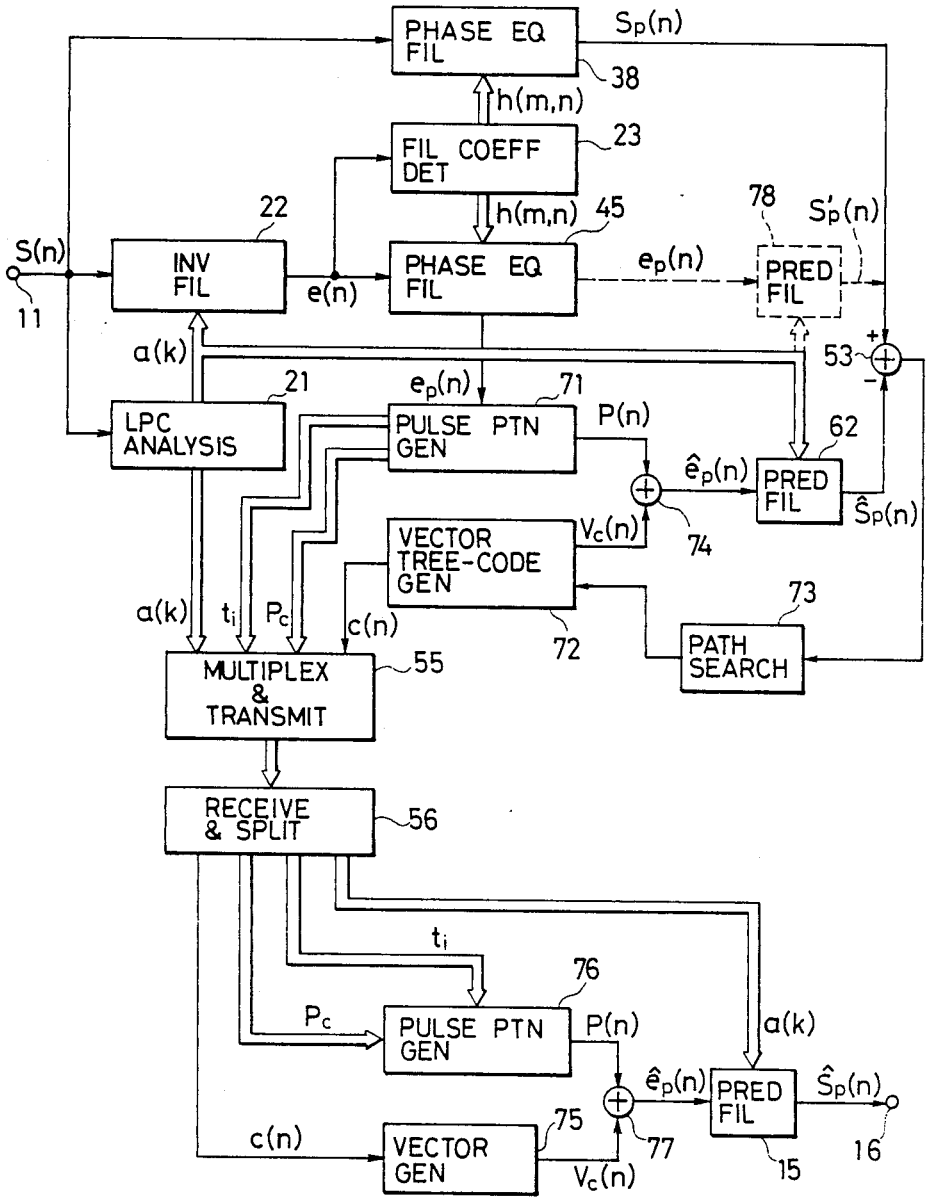
FIG. 10 is a block diagram showing an example of an arrangement of a speech analysis-synthesizing system utilizing the phase-equalizing processing.

It has been explained that in FIG. 9, the phase-equalized residual waveform $e_p(n)$ is pulsated and the pulse having an amplitude $m_l$ is coded at each pitch position. In order to enhance the quality of the regenerated speech more, it is possible to code and transmit the waveform portions where energy is concentrated in the phase-equalized residual waveform $e_p(n)$, that is, the portions of the waveform neighboring the pitch position $n_l$ as the center. An example is shown in FIG. 10. Similarly with respective descriptions stated before, the speech waveform S(n) is supplied to the LPC analysis part 21 and the inverse-filter 22. The inverse-filter 22 serves to remove the correlation among the sample values and to normalize the power and then to output the residual waveform e(n). The normalized residual waveform e(n) is supplied to the phase-equalizing filter 45 where the waveform e(n) is zero-phased to concentrate the energy thereof around the pitch position of the waveform. A pulse pattern generating part 71 detects the positions where energy is concentrated in the phase-equalized residual waveform $e_p(n)$ (FIG. 7C) from the phase-equalizing filter 45 and encodes, for example vector-quantize, the waveform of a plurality of samples (e.g. 8 samples) neighboring the pulse positions so as to obtain a pulse pattern P(n) such as shown in FIG. 7E. Namely, the pulse pattern (i.e. waveform) P(n) expressed by a vector of a plurality of samples is made to approximate the most similar one of standard vectors consisting of the same number of predetermined samples and the code Pc showing the standard vector is outputted. Further, the part 71 encodes the information showing the pulse positions of the pulse pattern P(n) within the analysis window (the pulse position information can be replaced by the pitch positions $n_l$) into the code $t_l$ and supplies thereof to the multiplexer/transmitter 55. The multiplexer/transmitter 55 multiplexes the code Pc of the pulse pattern P(n), the code $t_l$ of the pulse positions and the prediction coefficients a(k) into a stream of codes which is sent out. By this embodiment, it is possible to obtain higher quality synthesized speech than in the embodiment shown in FIG. 9.

Figure 7F:
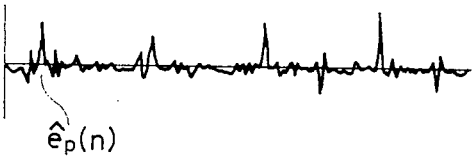
Figure 7G:
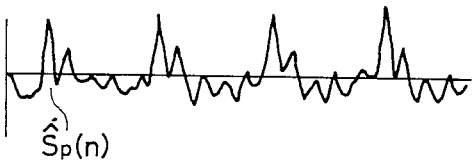

Further, this embodiment is arranged such that a signal $V_c(n)$ produced by taking the difference between the phase-equalized residual waveform $e_p(n)$ and the pulse pattern (the waveform neighboring the positions where energy is concentrated) is also coded and outputted. In this embodiment, the signal $V_c(n)$ is expressed by a vector tree code. Namely, a vector tree code generating part 72 successively selects the codes c(n) showing branches of a tree in accordance with the instructions of a path search part 73 (a code sequence optimizating part) and generates a decoded vector value $V_c(n)$. This vector value $V_c(n)$ and the pulse pattern P(n) are added in an adding circuit 74 so as to obtain a local decoded signal $\hat{e}_p(m)$ (shown in FIG. 7F) of the phase-equalized residual waveform $e_p(n)$. The signal $\hat{e}_p(m)$ is passed through a prediction filter 62 so as to obtain a local decoded speech waveform $\hat{S}_p(n)$. On the other hand, a sequence of codes of the vector tree code c(n) are determined by controlling the path search part 73 so as to minimize the square error or the frequency weighted error between the phase-equalized waveform $S_p(n)$ from the phase-equalizing filter 38 and the local decoded waveform $\hat{S}_p(n)$. The path search is carried out by successively leaving such candidates of the code c(n) in a tree-forming manner that minimize the difference after a certain time between the phase-equalizing speech waveform $S_p(n)$ and the local decoded waveform $\hat{S}_p(n)$. In this case, the code c(n) is also sent out to the multiplexer/transmitter 55.

In the receiving side, the receiver/splitter 56 separates from the received signal predication coefficients a(k), a pulse position code $t_i$, a waveform code (pulse pattern code) Pc and a difference code c(n). The difference code c(n) is supplied to a vector value generating part 75 for generation of a vector value $V_c(n)$. Both the codes Pc and $t_i$ are supplied to a pulse pattern generating part 76 to generate pulses of a pattern P(n) at the time positions determined by the code $t_i$. These vector value $V_c(n)$ and pulse pattern P(n) are added in the adding circuit 77 so as to decode a phase-equalized residual waveform $\hat{e}_p(n)$. The output thereof is supplied to the prediction filter 15. In the embodiment of FIG. 10, it is possible to omit the phase-equalizing filter 38 and arrange, as indicated by a broken line, that the phase-equalized residual waveform $e_p(n)$ is also supplied to a prediction filter 78 to regenerate a phase-equalized speech waveform $S_p(n)$, which is supplied to the adding circuit 53. The degree of the phase-equalizing filter 38 is, for example, about 30. The degree of the prediction filter 78 can be about 10 and thus the computation quantity for producing the phase-equalized speech waveform $S_p(n)$ by supplying the phase-equalized residual waveform $e_p(n)$ to the prediction filter 78 can be about one-third as much as that in the case of using the phase-equalizing filter 38. In this embodiment, since the phase-equalizing filter 45 is required for generating the pattern Pc, it is not particularly necessary to provide it. This falls upon the embodiment shown in FIG. 4. In FIG. 4, it is possible to delete the phase-equalizing filter 38 and obtain the phase-equalized speech waveform $S_p(n)$ by sending the phase-equalized residual waveform $e_p(n)$ through a prediction filter.

Figure 11:
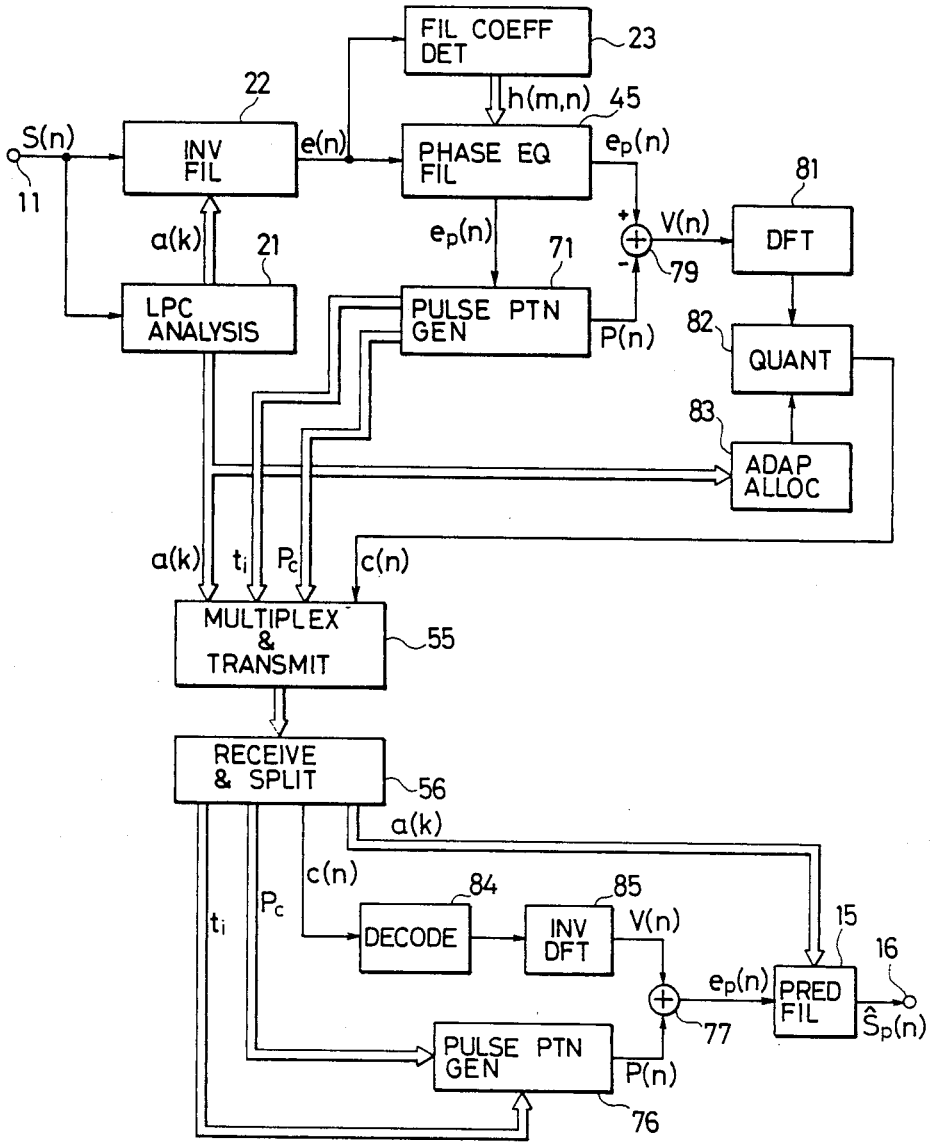
FIG. 11 is a block diagram showing another arrangement of the speech analysis-synthesizing system.

It has been explained that in FIG. 10, the portions except those where energy is concentrated are vector-tree coded; however, it is possible to encode them by ordinary tree coding. Further, it is possible to employ another coding, for example, frequency-quantizing. That is, for example, as shown in FIG. 11 where parts corresponding to those in FIG. 10 are identified by the same numerals, a subtractor 79 provides a difference V(n) between the phase-equalized residual waveform $e_p(n)$ and the pulse pattern P(n) and the difference signal V(n) is transformed into a signal of the frequency domain by a discrete Fourier transform part 81. The frequency domain signal is quantized by a quantizing part 82. During the quantization, it is preferable to adaptively allocate, by an adaptive bit allocating part 83, the number of quantization bits on the basis of the spectrum envelope expected from the prediction coefficients a(k). The quantization of the difference signal V(n) may be accomplished by using the method disclosed in detail in the Japanese patent application serial No. 57-204850 "An adaptive transform-coding scheme for a speech". The quantized code c(n) from the quantizing part 82 is supplied to the multiplexer/transmitter 55.

The decoding in relation to this embodiment is accomplished in such a manner that the code c(n) separated by the receiver/splitter 56 is decoded by a decoder 84 whose output is subjected to inverse discrete Fourier transform to obtain the signal V(n) of the time domain by an inverse discrete Fourier transform part 85. The other processings are similar to those in the case of FIG. 10.

As stated above, the speech signal processing method of the present invention has an effect of increasing the degree of concentrating the residual waveform amplitude with respect to time by phase-equalizing short-time phase characteristics of the prediction residual waveform, thereby allowing to detect a pitch period and a pitch position of a speech waveform. According to the present invention, the natural quality of a sound can be retained even if the pitch of the speech waveform is varied, for example, by removing the portions where energy is not concentrated from the speech waveform and thus shortening the time duration or by inserting zeros and thus lengthening the time duration and, in addition, coding efficiency can be greatly increased. Particularly, in the case where short-time phase characteristics of the prediction residual waveform are adaptively phase-equalized in accordance with the time change of the phase characteristics, it is possible to highly improve coding efficiency and the quality of speech.

The quality of speech in the case of performing only the phase-equalizing processing is equivalent to that of a 7.6-bit logarithmic compression PCM and thus a waveform distortion by this processing can be hardly recognized. Accordingly, even if a phase-equalized speech waveform is given as an input to be coded, degradation of speech quality at the input stage would not be brought about. Further, if the phase-equalized speech waveform is correctly regenerated, it is possible to obtain high speech quality even when this phase-equalized speech waveform is used as a driving sound source signal.

In any of the coding schemes shown in the above-stated embodiments, the coding efficiency is improved owing to high temporal concentration of the amplitude of the prediction residual waveform of a speech. In the variable-rate tree coding, information bits are allocated in accordance with the localization of a waveform amplitude as the time changes. Thus, as the amplitude localization is increased by the phase-equalization, the effect of the adaptive bit allocation increases, resulting in enhancement of the coding efficiency. When the coding is carried out with a coding efficiency of one bit per sample (about 10 kb/s), an SN ratio of the coded speech is 19.0 dB, which is 4.4 dB higher than the case of not employing a phase-equalizing processing. Further, from a view point of quality, the quality equivalent to a 5.5-bit PCM is improved to that equivalent to a 6.6-bit PCM owing to the use of phase-equalizing processing. Since no qualitative problem is caused with a 7-bit PCM, in this example, it is possible to obtain comparatively high quality even if a bit rate is lowered to 16 kb/s or less.

In the multi-pulse coding, since a residual waveform is pulsated by phase-equalizing processing, the multi-phase expression is more suitable for the coding and thus it is possible to express a residual waveform by utilizing a small number of pulses in comparison with the case of utilizing an input speech itself in the prior art. Further, since many of the pulse positions in the multi-pulse coding coincide with the pitch positions in this phase-equalizing processing, it is possible to simplify pulse position determining processing in the multi-pulse coding by utilizing the information of the pitch position. When the number of pulses of multi-pulse is 20

(corresponding to 1 bit/sample coding, which is about 10 kb/s), the performance in terms of SN ratio of the multi-pulse coding is 11.3 dB in the case of direct speech input and 15.0 dB in the case of phase-equalized speech. Thus, the SN ratio is improved by 3.7 dB through the employment of the phase-equalizing processing. Further, from a view point of quality, the quality equivalent to a 4.5-bit PCM is improved to that equivalent to a 6-bit PCM by the phase-equalizing processing. In the prior art, when the bit rate is lowered to 16 kb/s or less, the speech quality is abruptly degraded; however, if this multi-pulse coding is employed, it is possible to obtain comparatively excellent speech quality with the bit rate of 10 kb/s.

Figure 12:
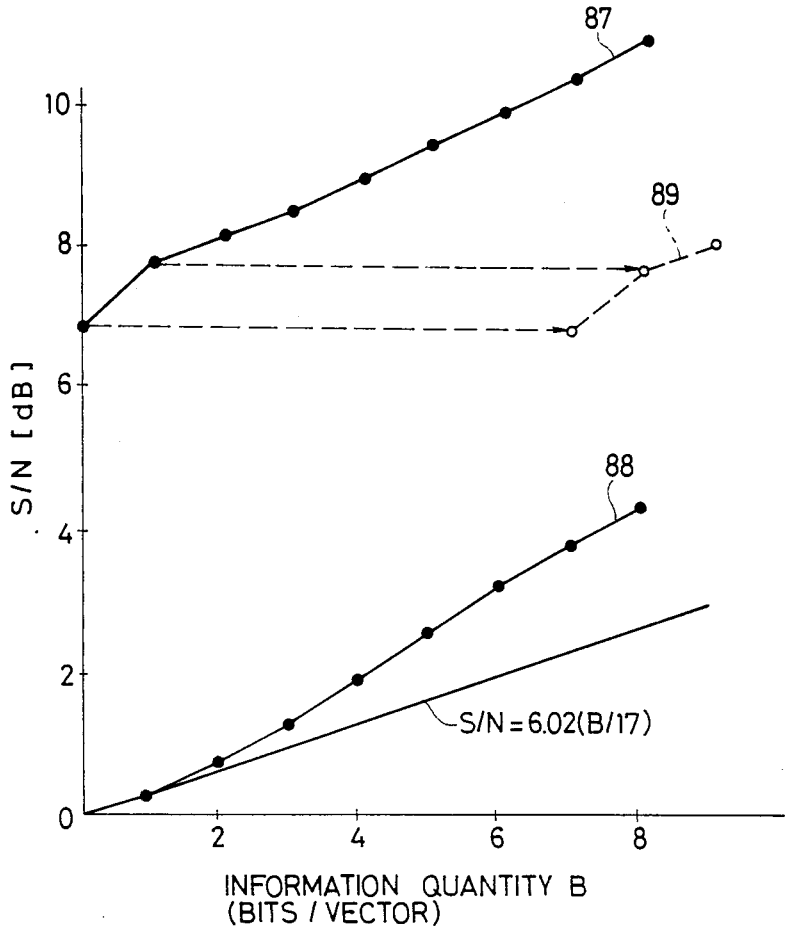
FIG. 12 is a graph showing comparison in effects of quantization of samples neighboring the pulse depending on the presence or absence of the phase-equalization.
Figure 13:
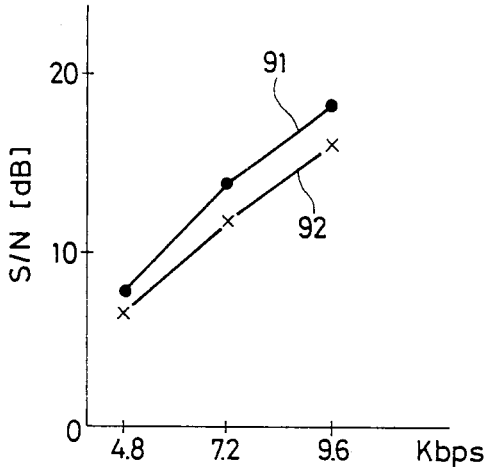
FIG. 13 is a graph showing comparison in quantization performance between the embodiment shown in FIG. 10 and a tree coding of an ordinary vector unit.
Figure 14:
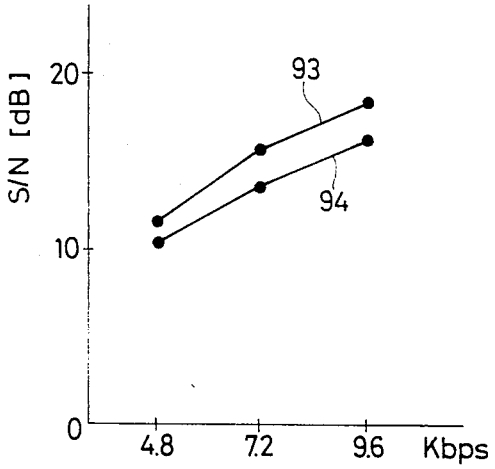
FIG. 14 is a graph showing comparison in quantization performance between the embodiment shown in FIG. 11 and an ordinary adaptive transformation-coding method utilizing a vector quantum.

FIG. 12 shows the effect caused when vector quantization is performed around a pulse pattern. The abscissa denotes information quantity. The ordinate denotes SN ratio showing the distortion caused when a pulse pattern dictionary is produced. A curve 87 is a case where the vector quantization is performed on a collection of 17 samples extracted from the phase-equalized prediction residual waveform all at the pitch positions (the number of samples of the pulse pattern P(n) is 17.). A curve 88 is a case where the vector quantization is performed on a prediction residual signal which is not to be phase-equalized. The prediction residual signal in the case of the curve 88 is nearly a random signal, while the signal in the case of the curve 87 is a collection of pulse patterns which are nearly symmetric at the center of a positive pulse. Thus, in the case of utilizing an average pattern of them, since this pulse pattern is known beforehand, the preparation of it can be carried out in the decoding side and thus it is not necessary to transmit the code Pc of the pulse pattern P(n). In this case, the information quantity is 0 and the distortion is smaller than that in the case of the curve 88 and, further, the SN ratio is improved by about 6.9 dB. When the position of each pulse is represented by seven bits, that is, a code $t_i$ is composed of 7 bits, the curve 87 is shifted to a curve 89 in parallel. Even in this case, it has a higher SN ratio than the curve 88. Namely, the entire distortion can be made smaller by quantizing the information of the pulse pattern and its position for a phase-equalized speech. FIG. 13 shows the comparison in SN ratio between the coding according to the method shown in FIG. 10 (curve 91) and the tree-coding of an ordinary vector unit (curve 92). FIG. 14 shows the comparison in SN ratio between the coding according to the method shown in FIG. 11 (curve 93) and the adaptive transform coding of a conventional vector unit (curve 94). The abscissa in each Figure represents a total information quantity including all parameters. As will be understood from these comparisons, the quantization distortion can be reduced by 1 to 2 dB by the coding method of this invention and it is possible to suppress the feeling of quantization distortion in the coded speech and to increase the quality thereby.

Incidentally, it is possible to employ $h^*(m,n_l)$ as filter coefficients of the phase-equalizing filter 38 and to omit the filter coefficient interpolating part 37. Aforementioned respective parts can be implemented by independent hardware or a microprocessor, otherwise it is possible to utilize one microprocessor or an electronic computer for plural parts. In the embodiments stated above, the output of the multiplexer/receiver 55 is transmitted to the receiving side where the decoding is carried out; however, instead of transmitting, the output of the multiplexer/receiver 55 may be stored in a memory device and, upon request, read out for decoding.

The coding of the energy-concentrated portions shown in FIGS. 10 and 11 is not limited to a vector coding of a pulse pattern. It is possible to utilize another method of coding.

What is claimed is:

1. A speech signal processing system comprising:

an input terminal for receiving successive sample values of a speech waveform S(n) at successive time points n, where n=0, 1, 2, . . . ;

inverse-filter means connected to said input terminal for obtaining successive sample values of a prediction residual waveform e(n) by removing a short-time correlation from the speech waveform S(n);

phase-equalizing filter means connected to said input terminal for receiving the speech waveform S(n) therefrom and producing successive samples of a phase-equalized speech waveform Sp(n) in the time domain by zero-phasing a prediction residual waveform component in the speech waveform in accordance with successive sets of M+1 phase-equalizing filter coefficients h(m,n) supplied thereto as filter coefficients thereof, where m=0, 1, 2, . . . , M, and M is a positive integer; and filter coefficient determining means connected to the output of said inverse-filter means for determining said phase-equalizing filter coefficients h(m,n) on the basis of said prediction residual waveform e(n), said filter coefficient determining means including voiced/unvoiced sound discriminator means connected to the output of said inverse-filter means for discriminating whether said speech waveform is a voiced sound or an unvoiced sound based on whether a computed value of an auto-correlation function on said prediction residual waveform during an analysis window of a length N at said filter coefficient determining means is above or below a threshold value, pitch position detecting means connected to the outputs of said inversefilter means and said voiced/unvoiced sound discriminator means for detecting, when said speech waveform is discriminated as a voiced sound, pitch positions $n_l$ from said prediction residual waveform e(n), and filter coefficient computing means connected to the outputs of said inverse-filter means, said voiced-/unvoiced sound discriminator means and said pitch position detecting means, respectively, for computing, when said speech waveform is discriminated as a voiced sound, a set of the M+1 phase-equalizing filter coefficients h(m,n) for a time point n of each pitch position $n=n_l$ by solving the following simultaneous equations given for K=0, 1, . . . M, $$\sum_{m=0}^{M} V(|m-k|)h(m, n_l) = \sum_{i=0}^{L-1} e(n_i - k)$$

where L is the number of the pitch positions $n_l$ in the analysis window and V(m) is an auto-correlation function of said prediction residual waveform e(n) given by:

$$V(m) = \sum_{n=0}^{N-m-1} e(n)e(n+m)$$

and for setting, when said speech waveform is discriminated as an unvoiced sound, a particular one order of coefficient of said phase-equalizing filter coefficients to a certain value and the other orders thereof to zero;

the output of said filter coefficient determining means being connected to said phase-equalizing filter means so that successive sets of said phase-equalizing filter coefficients $h(m,n_l)$ determined by said filter coefficient determining means are supplied to said phase-equalizing filter means as the filter coefficients thereof, whereby said phase-equalizing filter means outputs the phase-equalized speech waveform Sp(n) as the output of said system representing the input speech waveform.

2. The speech signal processing system according to claim 1 wherein the analysis window length N is selected comparable to a pitch period so that the number L of said pitch positions $n_l$ is one, and said filter coefficient computing means computes filter coefficients $h^*(m,n_l)$ instead of the coefficients $h(m,n_l)$ when the speech waveform is discriminated as a voiced sound by said voiced/unvoiced sound discriminating means, where $$h^*(m, n_l) = \frac{e(n_l + M/2 - m)}{\sqrt{\frac{1}{M+1} \sum_{k=-M/2}^{M/2} e^2(n_l + k)}}$$

and $e(n_l+M/2-m)$ denotes a sample value of said prediction residual waveform at the pitch position $n_l$.

3. The speech signal processing system according to claim 1 or 2 wherein said pitch position detecting means comprises a second phase equalizing filter means connected to the output of said inverse-filter means for phase-equalizing said prediction residual waveform e(n) from said inverse-filter means to produce a phase-equalized prediction residual waveform ep(n), filter coefficients of said second phase-equalizing filter means being controlled by the phase-equalizing filter coefficients determined by said filter coefficient determining means, and amplitude comparing means connected to the output of said second phase-equalizing means for detecting, as the pitch positions, time points at which relative amplitude values of the phase-equalized prediction residual waveform ep(n) within the analysis window are over a predetermined value.

4. The speech signal processing system according to claim 3 wherein said system further comprises:

pulse-processing means for detecting an amplitude $m_l$ of said phase-equalized prediction residual waveform ep(n) at the pitch position $n_l$ obtained by said pitch position detecting means; and quantizing means connected to the output of said pulse-processing means for quantizing said detected pulse amplitude and producing quantized pulse amplitude c(n);

the quantized pulse amplitude c(n), the pitch position $n_l$ $l$, a voiced or unvoiced sound discriminating value from said discriminator means and filter coefficients a(k) of said inverse-filter means being output as the output of the system representing the input speech signal.

5. The speech signal processing system according to claim 4 wherein said quantizing means comprises quantization step computing means connected to the output of said phase-equalizing filter means for computing the electric power v of said phase-equalized prediction residual waveform ep(n) supplied from said phase-equalizing filter means and a quantization step size from the computed electric power v, and adaptively varying a quantization step size of said quantizing means in accordance with the computed step size, the electric power of said phase-equalized prediction residual waveform being output as part of the output of said system representing the input speech waveform.

6. The speech signal processing system according to claim 1 or 2 wherein said filter coefficient determining means comprises filter coefficient interpolating means connected to the output of said filter coefficient computing means for interpolating the phase-equalizing filter coefficients for a time point between the computations of two successive sets of the phase-equalizing filter coefficients by said filter coefficient computing means so that the output of said filter coefficient determining means includes the interpolated phase-equalizing filter coefficients.

7. The speech signal processing system according to claim 1 or 2 wherein said system includes coding-processing means connected to the output of said phase-equalizing filter means for coding said phase-equalized speech waveform and outputting the coded phase-equalized speech waveform as the output of said system representing the input speech waveform.

8. The speech signal processing system according to claim 7 wherein said coding-processing means comprises:

a second phase-equalizing filter means connected to the output of said inverse-filter means for receiving therefrom the prediction residual waveform e(n) and producing a phase-equalized prediction residual waveform ep(n) in accordance with the phase-equalizing filter coefficients $h(m,n_l)$ supplied from said filter coefficient determining means as filter coefficients of said second phase-equalizing filter means;

tree code generating means connected to the output of said second phase-equalizing filter means for producing a series of sample values q(n) along a path of successive branches in a tree of codes defined in accordance with quantizing bit numbers R(n) for quantization of the phase-equalized prediction residual waveform ep(n), said path of successive branches being selected in accordance with a sequence of tree codes c(n);

prediction filter means connected to the output of said tree code generating means for receiving therefrom the sample values q(n) and producing a local decoded speech waveform $\hat{S}p(n)$, said prediction filter means being controlled by the same filter coefficients as those of said inverse-filter means;

difference detecting means connected to the outputs of said first mentioned phase-equalizing filter means and said second phase-equalizing filter means for detecting the difference between said phase-equalized speech waveform Sp(n) and the local decoded speech waveform $\hat{S}p(n)$; and code sequence optimizing merans connected to said tree code generating means for generating and supplying thereto sequences of tree codes, said code sequence optimizing means being connected to the output of said difference detecting means for receiving therefrom the detected difference and searching an optimum sequence of the tree codes which minimizes the detected difference produced by said difference detecting means;

the optimum code sequence c(n) obtained by said code sequence optimizing means and the filter coefficients for said inverse-filter means being outputted as the coded phase-equalized speech waveform.

9. The speech signal processing system according to claim 8 wherein said tree code generating means comprises:

subinterval setting means connected to the output of said second phase-equalizing filter means for receiving therefrom the phase-equalized prediction residual waveform ep(n) and determining an energy-concentrated position Td and a pitch period Tp of the phase-equalized prediction residual waveform and corresponding residual power $u_i$ of each subinterval within the pitch period from the phase-equalized prediction residual waveform;

bit allocating means connected to the output of said subinterval setting means for receiving therefrom the residual power $u_i$ and computing the quantizing bit number R(n) as the number of branches at each node in said tree code based on the residual power $u_i$, said number of branches representing the number of bits to be allocated to encode samples of the phase-equalized prediction residual waveform in the corresponding subinterval; and step size computing means connected to the output of said subinterval setting means for receiving therefrom the residual power $u_i$ and computing, based on the residual power, a quantization step size Δ(n) for quantizing the phase-equalized prediction residual waveform;

said tree of codes being defined by the computed number of branches R(n) at each node of the tree and said tree code generating means being operative to produce the sample value q(n) as a decoded value from the computed step size Δ(n) and the tree code c(n) on each selected branch, and the pitch period Tp, the pitch position Td and the residual power $u_i$ being outputted in codes from said coding-processing means as the output of said system representing the input speech waveform.

10. The speech signal processing system according to claim 7 wherein said coding-processing means comprises:

multi-pulse coding means connected to said filter coefficient determining means for determining pulse positions $t_i$ and pulse amplitudes $m_i$ with respect to the pitch position $n_l$ received from said filter coefficient determining means;

multi-pulse generating means connected to the output of said multi-pulse coding means for receiving therefrom the pulse positions $t_i$ and the pulse amplitudes $m_i$ and generating a multi-pulse signal ê(n) composed of a train of pulses having the amplitudes $m_i$ at the respective pulse positions $t_i$;

prediction filter means connected to the output of said multi-pulse coding means for producing a local decoded waveform Ŝp(n) by passing said multi-pulse signal through said prediction filter means while said prediction filter means is controlled by the same filter coefficients as those for said inverse-filter means; and difference detecting means connected to the outputs of said first mentioned phase-equalizing filter means and said second phase-equalizing filter means for receiving therefrom said phase-equalized speech waveform Sp(n) and said local decoded waveform Ŝp(n) and detecting the difference therebetween;

the output of said difference detecting means being connected to said multi-pulse coding means to supply thereto the detected difference, and said multi-pulse coding means determing the pulse positions $t_i$ and the pulse amplitudes $m_i$ so as to minimize the detected difference and being operative to output, as part of the coded speech speech waveform, the determined pulse positions $t_i$ and pulse amplitudes $m_i$ along with the filter coefficients a(k).

11. A speech signal processing system comprising:

an input terminal for receiving successive sample values of a speech waveform S(n) at successive time points n, where n=0, 1, 2, . . . ;

inverse-filter means connected to said input terminal for obtaining successive sample values of a prediction residual waveform e(n) by removing a short-time correlation from the speech waveform S(n);

phase-equalizing filter means connected to the output of said inverse-filter means for obtaining a phase-equalized residual waveform ep(n) in the time domain by zero-phasing the prediction residual waveform e(n) from said inverse-filter means in accordance with successive sets of M+1 phase-equalizing filter coefficients h(m,n) supplied thereto as filter coefficients thereof, where m=0, 1, 2, . . . , M and M is a positive integer; and filter coefficient determining means connected to the output of said inverse-filter means for determining said phase-equalizing filter coefficients h(m,n) on the basis of said prediction residual waveform e(n), said filter coefficient determining means including voiced/unvoiced sound discriminator means connected to the output of said inverse-filter means for discriminating whether said speech waveform is a voiced sound or unvoiced sound based on whether a computed value of an auto-correlation function on said prediction residual waveform during an analysis window of a length N at said filter coefficient determining means is above or below a threshold value, pitch position detecting means connected to the outputs of said inverse-filter means and said voiced/unvoiced sound discriminator means for detecting, when said speech waveform is discriminated as a voiced sound, pitch positions $n_l$ from said prediction residual waveform e(n), and filter coefficient computing means connected to the outputs of said inverse-filter means, said voiced-/unvoiced sound discriminator means and said pitch position detecting means, respectively, for computing, when said speech waveform is discriminated as a voiced sound, a set of the M+1 phase-equalizing filter coefficients h(m,n) for a time point n of each pitch position $n=n_l$ by solving the following simultaneous equations given for k=0, 1, . . . M, $$\sum_{m=0}^{M} V(|m-k|)h(m, n_l) = \sum_{i=0}^{L-1} e(n_i - k)$$

where L is the number of the pitch positions $n_l$ in the analysis window and V(m) is an auto-correlation function of said prediction residual waveform e(n) given by:

$$V(m) = \sum_{n=0}^{N-m-1} e(n)e(n+m)$$

and for setting, when said speech waveform is discriminated as an unvoiced sound, a particular one order of coefficient of said phase-equalizing filter coefficients to a certain value and the other orders thereof to zero;

the output of said filter coefficient determining means being connected to said phase-equalizing means so that successive set of said phase-equalizing filter coefficients $h(m,n_l)$ determined by said filter coefficient determining means are supplied to said phase-equalizing filter means as filter coefficients thereof, whereby said phase-equalizing filter means outputs the phase-equalized prediction residual waveform ep(n) as the output of said system representing the input speech waveform.

12. The speech signal processing system according to claim 11 wherein the analysis window length N is selected comparable to a pitch period so that the number L of said pitch positions $n_l$ is one, and said filter coefficient computing means computes filter coefficients $h^*(m,n_l)$ instead of the coefficients $h(m,n_l)$ when the speech waveform is discriminated as a voiced sound by said voiced/unvoiced sound discriminating means, where $$h^*(m, n_l) = \frac{e(n_l + M/2 - m)}{\sqrt{\frac{1}{M+1} \sum_{K=-M/2}^{M/2} e^2(n_l + k)}}$$

and $e(n_l + M/2 - m)$ denotes a sample value of said prediction residual waveform at the pitch position $n_l$.

13. The speech signal processing system according to claim 11 or 12 wherein said pitch position detecting means comprises a second phase equalizing filter means connected to the output of said inverse-filter means for phase-equalizing the prediction residual waveform e(n) from said inverse filter means to produce a phase-equalized prediction residual waveform ep(n), filter coefficients of said second phase-equalizing filter means being controlled by the phase-equalizing filter coefficients determined by said filter coefficient determining means, and amplitude comparing means connected to the output of said second phase equalizing filter means for detecting, as the pitch positions, time points at which relative amplitude values of the phase-equalized prediction residual waveform ep(n) within the analysis window are over a predetermined value.

14. The speech signal processing system according to claim 11 or 12 wherein said filter coefficient determining means comprises filter coefficient interpolating means connected to the output of said filter coefficient computing means for interpolating the phase-equalizing filter coefficients for a time point between the computations of two successive sets of the phase-equalizing filter coefficients by said filter coefficient computing means so that the output of said filter coefficient determining means includes the interpolated phase-equalizing filter coefficients.

15. The speech signal processing system according to claim 11 wherein said system further comprises coding-processing means connected to the output of said phase-equalizing filter means for coding the phase-equalized prediction residual waveform and outputting the coded phase-equalized prediction residual waveform as the output of said system representing the input speech waveform.

16. The speech signal processing system according to claim 15 wherein said coding processing means includes energy-concentrated portion coding means connected to the output of said phase-equalizing means for detecting a position $t_i$ of each energy-concentrated portion in said phase-equalized residual waveform and coding the energy-concentrated portion to produce a code Pc representing the energy concentrated portion, the code of the energy-concentrated portion Pc and a code showing the energy-concentrated position $t_i$ being outputted along with codes of said filter coefficients a(k) of said inverse-filter means as the output of said system representing the input speech waveform.

17. The speech signal processing system according to claim 16 wherein said energy-concentrated portion coding means comprises pulse pattern generating means for reproducing a pulse pattern signal P(n) composed of a train of the energy-concentrated portions each centered at the respective energy-concentrated positions $t_i$ of said phase-equalized prediction residual waveform, and said coding processing means further comprises difference signal coding means connected to the output of said energy-concentrated portion coding means for generating a difference code c(n) representing a difference between said pulse pattern signal P(n) and said phase-equalized prediction residual waveform, said difference code c(n) being outputted as part of the output of said system representing the input speech waveform.

18. The speech signal processing system according to claim 17 wherein said pulse pattern generating means produces the pulse pattern signal P(n) by vector-quantizing a waveform of plural samples of each said energy-concentrated portion.

19. The speech signal processing system according to claim 17 wherein said difference signal coding means comprises subtraction means connected to the outputs of said phase-equalized filter means and said pulse pattern generating means for receiving the phase-equalized prediction residual waveform ep(n) and the pulse pattern signal P(n) and producing a difference therebetween as a difference signal V(n), and spectrum quantizing means connected to the output of said subtraction means for quantizing frequency components of said difference signal V(n) to produce a spectrum envelope code as the difference code c(n) representing said difference signal.

20. The speech signal processing system according to claim 17 wherein said difference signal coding means comprises vector code generating means for producing said difference code c(n) and a decoded vector value Vc(n) based on said difference code c(n), adder means connected to the outputs of said pulse pattern generating means and said vector code generating means for adding said pulse pattern signal P(n) and said decoded vector value Vc(n) received therefrom to produce a local decoded residual waveform êp(n), first prediction filter means connected to the output of said adder means for receiving therefrom the local decoded residual waveform êp(n) and producing a local decoded speech waveform Ŝp(n) by controlling filter coefficients of said prediction filter means with the same filter coefficients as those for said inverse-filter means, second prediction filter means connected to the output of said phase-equalizing filter means for regenerating a phase-equalized speech waveform $\hat{S}p(n)$ from said phase-equalized prediction residual waveform ep(n), subtraction means connected to the outputs of said first and second prediction filter means for producing a difference between said regenerated phase-equalized speech waveform Sp(n) and said local decoded speech waveform $\hat{S}p(n)$, and path search means connected to receive the difference and to control successive selections of said difference codes in said vector code generating means so that said difference becomes minimum.

21. The speech signal processing system according to claim 17 wherein said difference signal coding means comprises means for determining as the difference code c(n) a code of an optimum vector-tree value Vc(n) representing the difference between said phase-equalized residual waveform and said pulse pattern signal P(n).

22. The speech signal processing system according to claim 17 wherein said difference signal coding means comprises means for quantizing frequency components of the difference between said phase-equalized residual waveform and said pulse pattern signal and outputting the quantized results as the difference code c(n).

* * * * *